US011337531B2

(12) United States Patent
Zhang et al.

(10) Patent No.: US 11,337,531 B2
(45) Date of Patent: May 24, 2022

(54) MODULAR POINT-OF-SALE DISPLAY

(71) Applicant: Colgate-Palmolive Company, New York, NY (US)

(72) Inventors: Reid Zhang, Shanghai (CN); Sophia Chen, Shanghai (CN); Michelle Han, Shanghai (CN)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/733,772

(22) PCT Filed: Apr. 27, 2018

(86) PCT No.: PCT/CN2018/084761

§ 371 (c)(1),
(2) Date: Oct. 21, 2020

(87) PCT Pub. No.: WO2019/205076

PCT Pub. Date: Oct. 31, 2019

(65) Prior Publication Data

US 2021/0235888 A1 Aug. 5, 2021

(51) Int. Cl.
*A47F 5/11* (2006.01)
*A47F 5/08* (2006.01)
(Continued)

(52) U.S. Cl.
CPC ..... *A47F 5/11* (2013.01); *A47F 5/08* (2013.01); *A47F 5/0884* (2013.01);
(Continued)

(58) Field of Classification Search
CPC .. A47F 5/11; A47F 5/08; A47F 5/0006; A47F 5/0884; A47F 7/143;
(Continued)

(56) References Cited

U.S. PATENT DOCUMENTS 1,136,453 A * 4/1915 Warren ..... A47F 5/112 211/69.9
1,687,881 A * 10/1928 Myers ..... A47F 5/112 206/481

(Continued)

FOREIGN PATENT DOCUMENTS

CN 105083788 11/2015
FR 2897044 8/2007

(Continued)

OTHER PUBLICATIONS

International Search Report and the Written Opinion of the International Searching Authority issued in International Application PCT/CN2018/084761 dated Jan. 30, 2019.

*Primary Examiner* — Jennifer E. Novosad

(57) ABSTRACT

A modular point-of-sale display comprising a plurality of inter-lockable display units comprising a primary display unit comprising a primary multi-panel structure comprising a plurality of primary product display apertures configured and arranged to receive a plurality of first products for display a hanger element for mounting the primary display unit to a support structure; and a primary mounting element; and an add-on display unit comprising: an add-on structure comprising a plurality of add-on product display apertures configured and arranged to receive a plurality of second products for display; an add-on mounting element configured to mate with the primary mounting element to hang the add-on display unit from the primary display unit.

14 Claims, 21 Drawing Sheets

(51) Int. Cl.
*A47F 7/00* (2006.01)
*A47F 5/00* (2006.01)

(52) U.S. Cl.
CPC ..... *A47F 7/0028* (2013.01); *A47F 7/0035* (2013.01); *A47F 2005/0012* (2013.01)

(58) Field of Classification Search
CPC ..... A47F 2005/0012; A47F 5/112; A47F 7/0028; A47F 7/0035; A47F 5/116; A47B 43/02; A47B 47/06; A47B 55/06
USPC ..... 211/113, 188, 194, 72, 70.1, 73; 206/485, 486, 780, 779, 533, 806
See application file for complete search history.

(56) References Cited

U.S. PATENT DOCUMENTS 1,747,642 A * 2/1930 Neitzke ..... A47F 7/283 211/85.26
1,852,471 A * 4/1932 Nelson ..... A47F 5/112 108/60
1,881,707 A * 10/1932 Larkin ..... A47F 5/112 211/73
1,940,909 A * 12/1933 Hermani ..... A47F 1/10 221/131
2,056,067 A * 9/1936 Hines ..... G09F 5/00 211/73
2,104,523 A * 1/1938 Lichtenstein ..... A47F 1/08 221/197
2,256,339 A * 9/1941 Fallert ..... G09F 5/02 312/198
2,267,378 A * 12/1941 Snelling ..... A47F 5/112 211/69.9
2,313,620 A * 3/1943 Brunner ..... A47F 5/112 211/70.1
2,548,289 A * 4/1951 Carraher ..... B25B 11/00 211/13.1
2,549,568 A * 4/1951 Hubert ..... G09F 5/042 206/733
2,842,263 A * 7/1958 Giraudet ..... B65D 85/325 206/485
2,899,078 A * 8/1959 Magnus ..... G09F 5/00 211/70.1
2,905,332 A * 9/1959 Myers ..... A47F 5/112 211/70.1
2,923,417 A * 2/1960 Sonksen ..... A47F 5/05 211/165
2,974,782 A * 3/1961 Edgar ..... B65D 77/26 206/69
3,170,260 A * 2/1965 Parker ..... A47F 7/143 40/124
3,302,776 A * 2/1967 Sparks ..... B65D 25/107 206/485
3,333,708 A * 8/1967 Leblanc ..... A47F 7/021 211/85.1
3,429,451 A * 2/1969 Samsing ..... A47F 5/112 211/72
3,433,365 A * 3/1969 Hodson ..... A47F 5/11 248/220.31
3,462,020 A * 8/1969 Hall ..... A47F 5/112 211/26.2
3,739,917 A 6/1973 Okutani
3,834,324 A 9/1974 Lang
4,043,485 A * 8/1977 Tippetts ..... H05K 13/0084 221/312 R
4,134,493 A * 1/1979 Cech ..... B65D 5/504 206/320
4,146,127 A * 3/1979 Bayer ..... B65D 5/5042 206/294
4,310,094 A * 1/1982 Hotchkiss, Jr. ..... B25H 3/04 211/70.6
4,488,652 A * 12/1984 Hinton ..... A47F 5/116 211/149
4,573,590 A * 3/1986 Ellis ..... A47F 5/0068 211/118
4,678,088 A 7/1987 Flum
4,733,782 A * 3/1988 Spezial ..... A47F 5/0876 211/106.01
4,813,553 A * 3/1989 Franklin ..... A47F 5/10 211/133.1
4,854,246 A * 8/1989 Belokin ..... A47F 5/116 108/162
5,025,936 A 6/1991 Lamoureaux
5,083,663 A * 1/1992 Conway ..... B65D 5/5206 206/45.26
5,183,166 A * 2/1993 Belokin, Jr. ..... A47F 5/116 211/130.1
5,248,036 A * 9/1993 Radocha, Sr. ..... A47F 5/0006 206/479
5,346,166 A * 9/1994 Valiulis ..... A47F 5/0068 211/57.1
5,358,116 A * 10/1994 Brintazzoli ..... B65D 5/5061 206/485
5,361,907 A * 11/1994 Mohrhauser ..... B65D 5/5021 206/443
5,392,902 A * 2/1995 Vlastakis ..... A47B 57/00 108/165
5,392,919 A * 2/1995 Passamoni ..... B65D 73/0085 206/223
5,402,889 A * 4/1995 Hermann ..... B65D 5/4233 206/443
5,415,370 A * 5/1995 Valiulis ..... A47F 5/0006 211/57.1
5,443,168 A 8/1995 Dyment et al.
5,544,755 A * 8/1996 Paumen ..... B65D 71/16 206/485
5,664,380 A * 9/1997 Hsueh ..... E04B 2/7437 211/184
5,823,338 A * 10/1998 Osterle ..... F16B 27/00 206/338
5,878,884 A * 3/1999 Mayled ..... B65D 73/0021 206/455
5,957,422 A * 9/1999 Shea ..... A47F 5/0807 248/220.31
6,006,929 A * 12/1999 Leonard ..... A47F 5/01 211/106
6,039,188 A * 3/2000 Lee ..... B25H 3/04 206/378
6,098,818 A * 8/2000 Ali ..... A47F 7/143 211/50
6,135,033 A * 10/2000 Deferrari ..... A47F 5/116 108/165
6,283,312 B1 * 9/2001 Edgerton ..... A47F 5/0006 211/113
6,286,690 B1 * 9/2001 Thalenfeld ..... A47F 5/0006 211/113
6,340,091 B1 * 1/2002 Romeo ..... A47F 1/082 211/113
6,382,433 B1 * 5/2002 Podergois ..... A47F 5/10 211/195
6,474,483 B1 * 11/2002 Montoya ..... A47B 47/06 211/149
6,581,789 B1 * 6/2003 Spanski ..... A47F 5/101 211/103
6,675,978 B2 * 1/2004 Shea ..... A47F 5/0823 211/181.1
6,715,623 B2 4/2004 Broerman
6,752,280 B2 6/2004 Dye
6,929,133 B1 * 8/2005 Knapp, III ..... A47F 5/0807 211/118
6,942,110 B2 * 9/2005 Martins ..... A47F 5/01 211/59.1
7,121,416 B2 * 10/2006 Shea ..... A47F 5/0807 211/87.01
7,219,459 B2 * 5/2007 Valiulis ..... G09F 3/14 206/806
7,258,241 B2 * 8/2007 Reid ..... B65G 1/1373 211/103

(56) References Cited

U.S. PATENT DOCUMENTS

| | | | | |
|---|---|---|---|---|
| 7,387,213 | B1 * | 6/2008 | Smalley | A47B 57/482 211/106 |
| D584,605 | S * | 1/2009 | Hedlund | D9/415 |
| 7,500,574 | B1 | 3/2009 | Bunch | |
| 7,641,061 | B1 * | 1/2010 | Cuzzocrea | A47F 5/083 211/113 |
| 7,712,616 | B2 * | 5/2010 | Barkdoll | A47F 5/0807 211/59.1 |
| 7,731,039 | B1 * | 6/2010 | Minger | A47F 7/0078 211/88.01 |
| 7,882,966 | B2 | 2/2011 | Broerman et al. | |
| 7,886,916 | B2 * | 2/2011 | Alyn | A47F 5/0807 211/55 |
| 7,905,365 | B2 * | 3/2011 | Virvo | A47F 5/116 211/73 |
| 7,918,351 | B2 * | 4/2011 | Zimmer | A47F 5/116 211/40 |
| 7,954,655 | B2 * | 6/2011 | Virvo | A47F 5/0043 211/149 |
| 7,967,154 | B1 * | 6/2011 | Sharon | A47J 47/16 211/126.16 |
| 8,091,715 | B2 * | 1/2012 | Roth | A47B 57/20 211/187 |
| 8,814,108 | B2 * | 8/2014 | Bernstein | A47F 5/0006 248/125.3 |
| 9,204,738 | B2 | 12/2015 | Sitton | |
| 9,307,848 | B2 * | 4/2016 | Bernstein | A47F 5/0006 |
| 9,629,484 | B2 * | 4/2017 | Brozak | A47F 7/0014 |
| 9,867,483 | B2 * | 1/2018 | Shea | A47F 5/0815 |
| 10,334,968 | B2 * | 7/2019 | Shea | A47F 5/0869 |
| 2003/0000904 | A1 * | 1/2003 | Lung | A47F 5/05 211/163 |
| 2004/0004018 | A1 * | 1/2004 | Nittono | B65D 73/0078 206/461 |
| 2005/0274684 | A1 * | 12/2005 | Swanson | A47B 43/02 211/78 |
| 2006/0091092 | A1 * | 5/2006 | Vosbikian | A47F 5/01 211/87.01 |
| 2006/0118683 | A1 * | 6/2006 | Speed | A47F 5/0884 248/222.11 |
| 2006/0207955 | A1 * | 9/2006 | Ouyang | A47B 57/00 211/103 |
| 2007/0029271 | A1 * | 2/2007 | Belokin | A47F 5/0892 211/113 |
| 2007/0163973 | A1 * | 7/2007 | Smokowicz | F16M 11/041 211/70 |
| 2007/0181518 | A1 * | 8/2007 | Bartley | A47F 5/0006 211/94.02 |
| 2007/0241070 | A1 * | 10/2007 | Maheu | A47F 5/0815 211/59.1 |
| 2007/0284490 | A1 * | 12/2007 | Cox | G09F 1/14 248/174 |
| 2010/0006529 | A1 * | 1/2010 | Groff | A47F 5/116 211/186 |
| 2010/0051568 | A1 * | 3/2010 | Kalwat | A47F 5/116 211/135 |
| 2010/0181443 | A1 * | 7/2010 | Bojie | A47F 5/11 248/146 |
| 2018/0146803 | A1 * | 5/2018 | Urban | B65D 5/0218 |
| 2018/0168369 | A1 * | 6/2018 | Goldmeier | A47F 5/112 |
| 2018/0220812 | A1 * | 8/2018 | Shea | G09F 7/18 |
| 2019/0320822 | A1 * | 10/2019 | Belokin | A47F 7/0042 |
| 2021/0235888 | A1 * | 8/2021 | Zhang | A47F 5/11 |
| 2021/0251400 | A1 * | 8/2021 | Coan | A47F 5/112 |

FOREIGN PATENT DOCUMENTS

| | | |
|---|---|---|
| GB | 2462501 | 2/2010 |
| GB | 2510478 | 8/2014 |
| JP | H09-121992 | 5/1997 |
| KR | 200481630 | 11/2016 |
| WO | 2010/018322 | 2/2010 |
| WO | 2012/115574 | 8/2012 |

* cited by examiner

MODULAR POINT-OF-SALE DISPLAY

FIELD

The present invention relates to a modular point-of-sale display.

BACKGROUND

Point of purchase display shelving is often fabricated from metal and designed to be quickly set up. However, such displays are typically very generic in shape and can be relatively heavy and/or bulky. Additionally, such displays are limited in the amount variation as to how a product may be oriented within the shelving—thereby reducing consumer engagement as the consumer may not see all products contained within the shelving. Thus, there exists a need for an improved point-of-sale display that provides for quick set up, reduced bulk, and better consumer engagement.

SUMMARY

In some embodiments, the present invention includes a modular point-of-sale display comprising: a plurality of inter-lockable display units comprising: a primary display unit comprising: a primary structure comprising a plurality of primary product display apertures configured and arranged to receive a plurality of first products for display; a hanger element for mounting the primary display unit to a support structure; and a primary mounting element; and an add-on display unit comprising: an add-on structure comprising a plurality of add-on product display apertures configured and arranged to receive a plurality of second products for display; a first add-on mounting element configured to mate with the primary mounting element to hang the add-on display unit from the primary display unit.

Other embodiments of the present invention include a point-of-sale display comprising: a display unit comprising: a hanger element for mounting the display unit to a support structure; a rear panel extending along a central vertical axis and comprising first and second sides edges on opposite sides of the central vertical axis; a first side panel coupled to the first side edge of the rear panel and extending from a front surface of the rear panel, the first side panel comprising a first set of product display apertures; and a second side panel coupled to a second side edge of the rear panel and extending from the front surface of the rear panel, the second side panel comprising a second set of product display apertures; and a plurality of products positioned in the display unit to extend through the first set of product display apertures and the second set of product display apertures, the products supported by the first side panel and the second side panel so that middle portions of the products are located between the first side panel and the second side panel, first end portions of the products protrude from the first side panel in a first direction, and second end portions of the products protrude from the second side panel in a second direction opposite the first direction.

In other embodiments, the present invention includes a point-of-sale display comprising: a display unit formed of a single sheet of folded material, the display unit comprising: a hanger element for mounting the primary display unit to a support structure; a first set of product display apertures; and a second set of product display apertures; and a plurality of products positioned in the display unit to extend through the first set of product display apertures and the second set of product display apertures.

Other embodiments of the present invention include a blank for forming a product display unit, the blank comprising: a flat sheet of material; a first pre-weakened line formed in the flat sheet of material; a second pre-weakened line formed in the flat sheet of material, a rear panel being formed between the first and second pre-weakened lines, a first side panel formed between the first pre-weakened line and a first side edge of the flat sheet of material, and a second side panel formed between the second pre-weakened line and a second side edge of the flat sheet of material; a first set of product display apertures formed in the first side panel; and a second set of product display apertures formed in the second side panel aligned with the first set of product display apertures.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
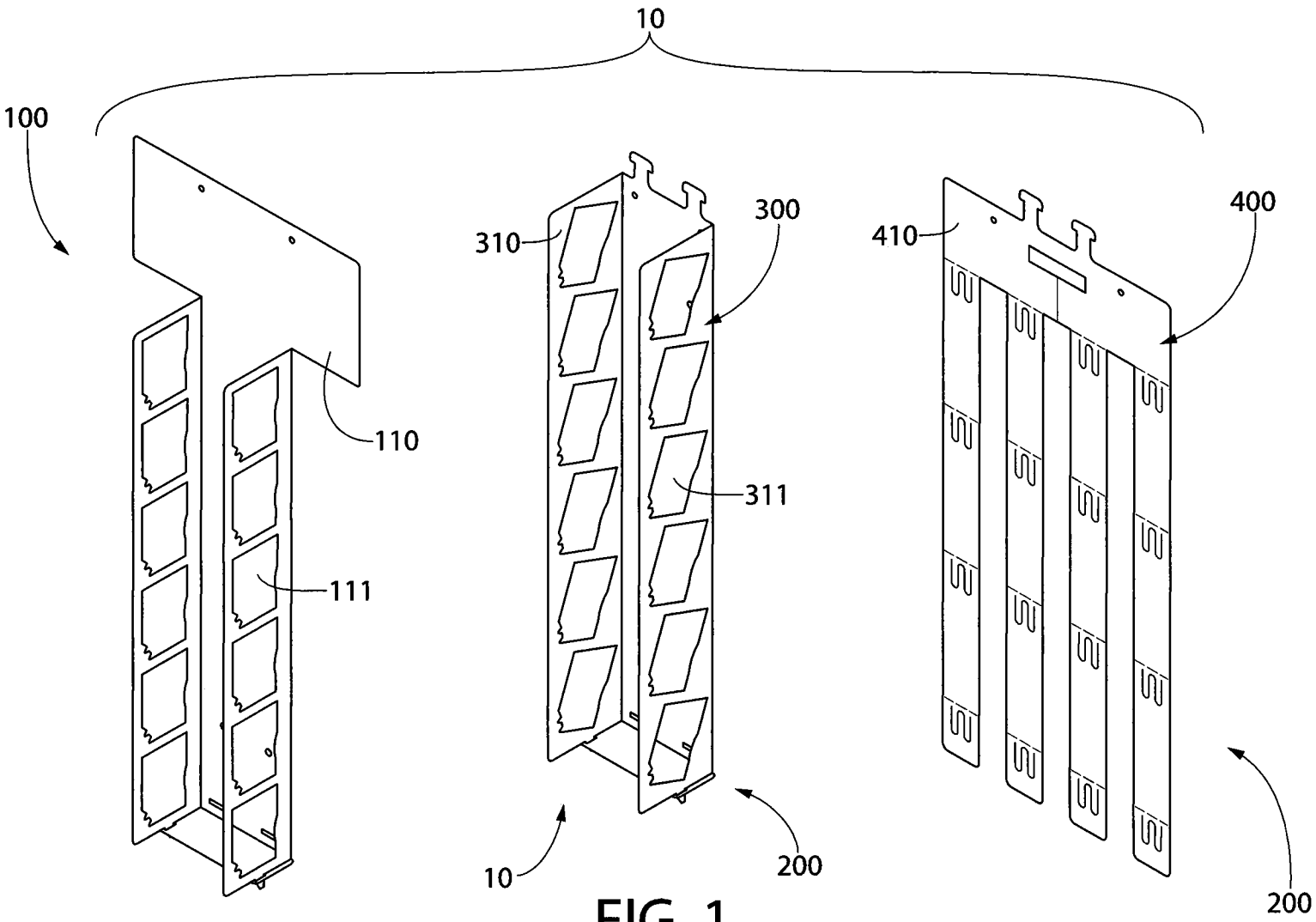
FIG. 1 is a perspective view of separate components of a modular point-of-sale display.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means +/−5% of the reference value. According to the present application, the phrase "substantially free" means less than about 0.1 wt. % based on the total of the referenced value. According to the present application, the phrase "substantially equal" means ±5% of the referenced value.

Referring to FIG. 1, the present invention is directed to a modular point-of-sale display 10 (referred to herein as a "display"). The display 10 may comprise a plurality of inter-lockable display units 100, 200 that may include a primary display unit 100 and an add-on display unit 200. The add-on display unit 200 may be a first add-on display unit 300. In other embodiments, the add-on display unit 200 may be a second add-on display unit 400. In other embodiments, the add-on display unit 200 may comprise at least one of the first add-on display until 300 and the second add-on display unit 400. According to some embodiments of the present invention, the display 10 may comprise the primary display unit 100 and the first add-on display unit 300. According to some embodiments, the display 10 may comprise the primary display unit 100 and the second add-on display unit 400. According to some embodiments, the display 10 may comprise the primary display unit 100, the first add-on display unit 300, and the second add-on display unit 400.

Figure 2:
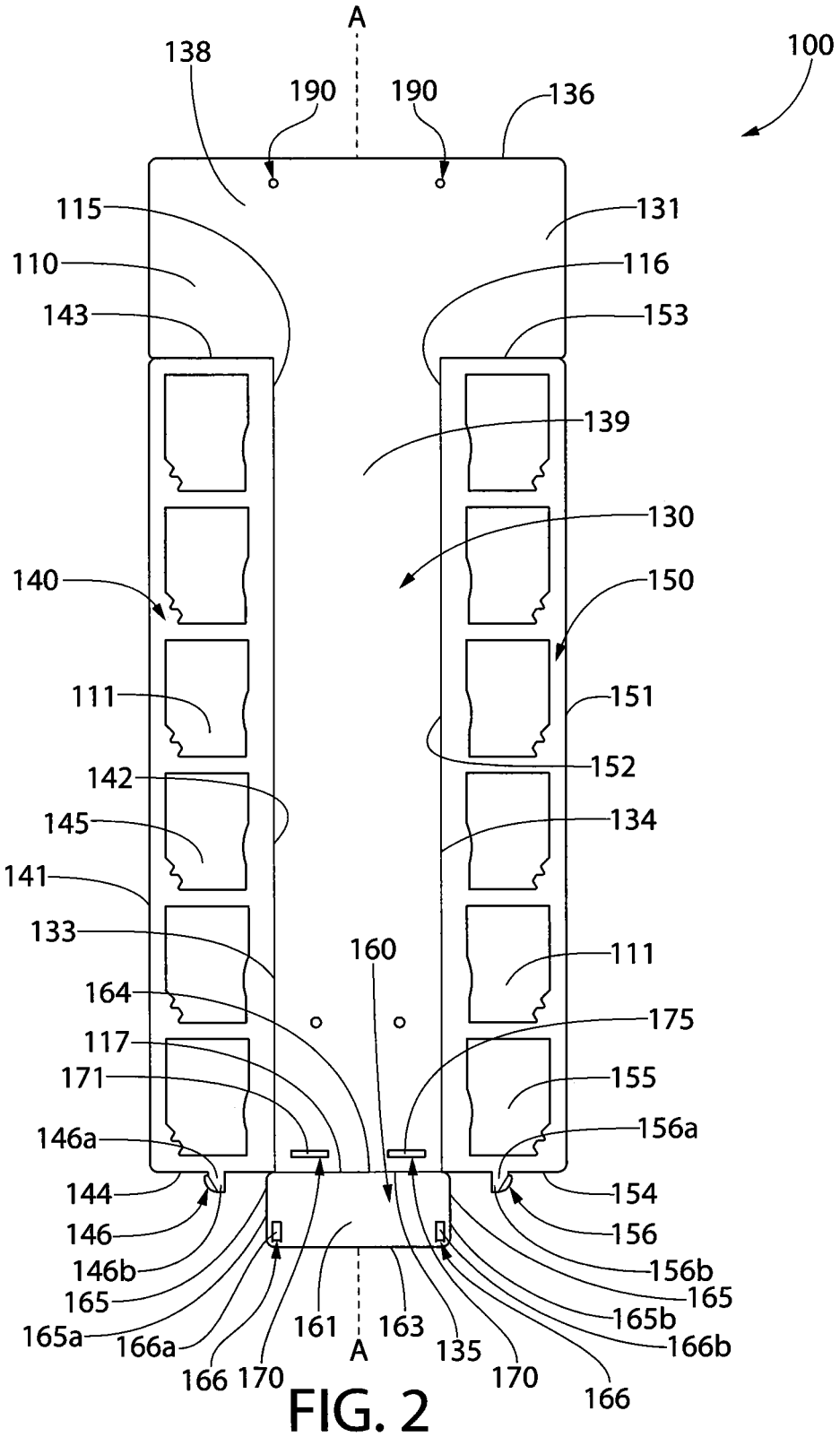
FIG. 2 is a front plan view of a primary display unit in an unassembled state.
Figure 3:
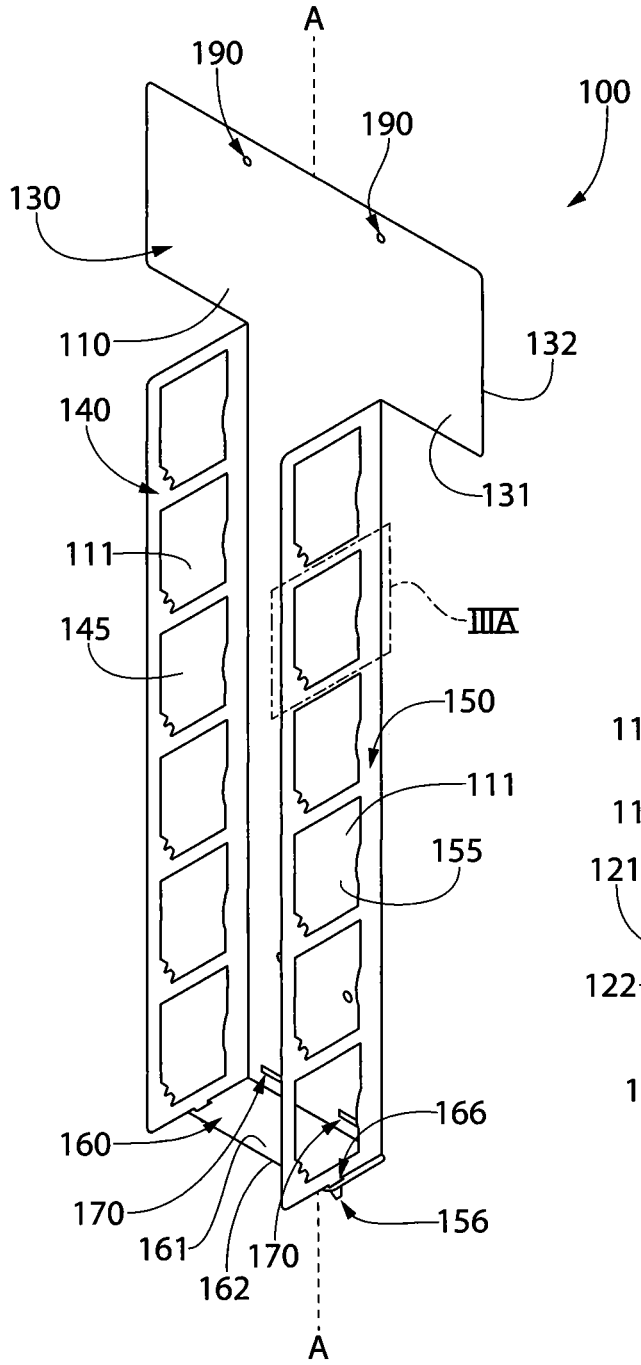
FIG. 3 is a front perspective view of the primary display unit of FIG. 2 in an assembled state.
Figure 3A:
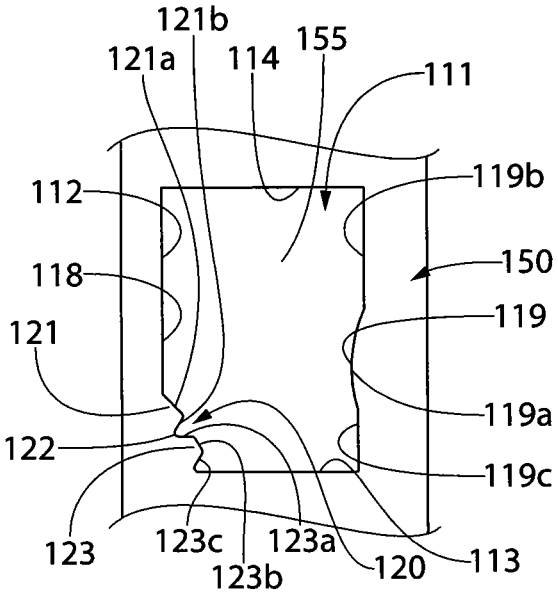
FIG. 3A is a close-up plan sideview of area IIIA of the primary display unit of FIG. 3 in an assembled state.
Figure 3B:
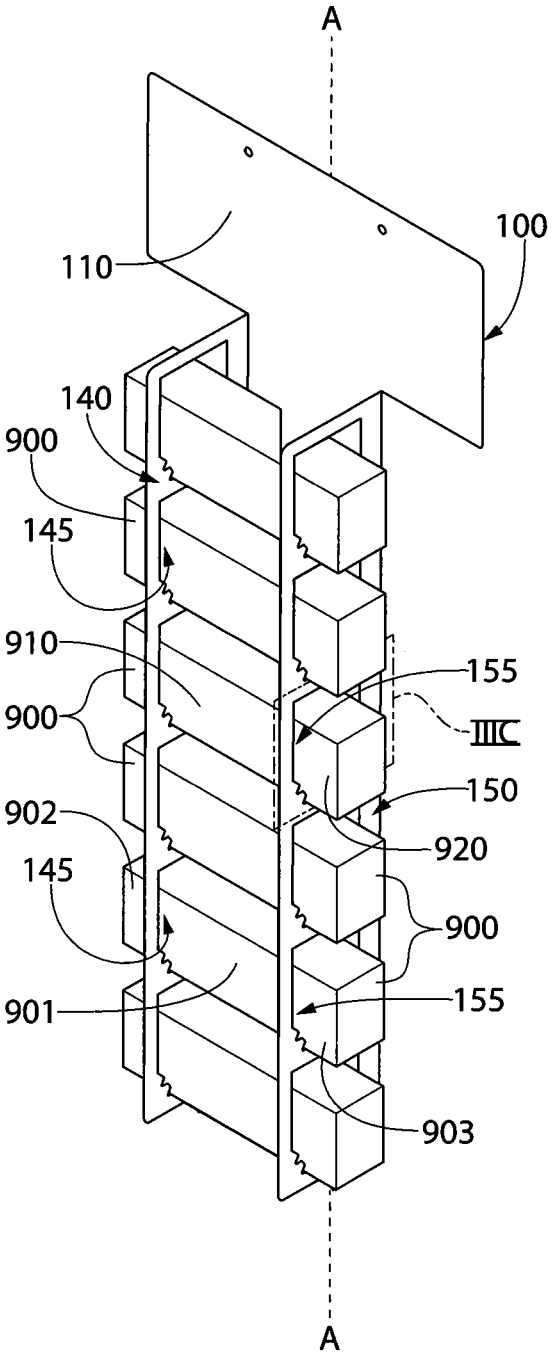
FIG. 3B is a front perspective view of the primary display unit of FIG. 3 with a plurality of packages inserted therein.
Figure 4:
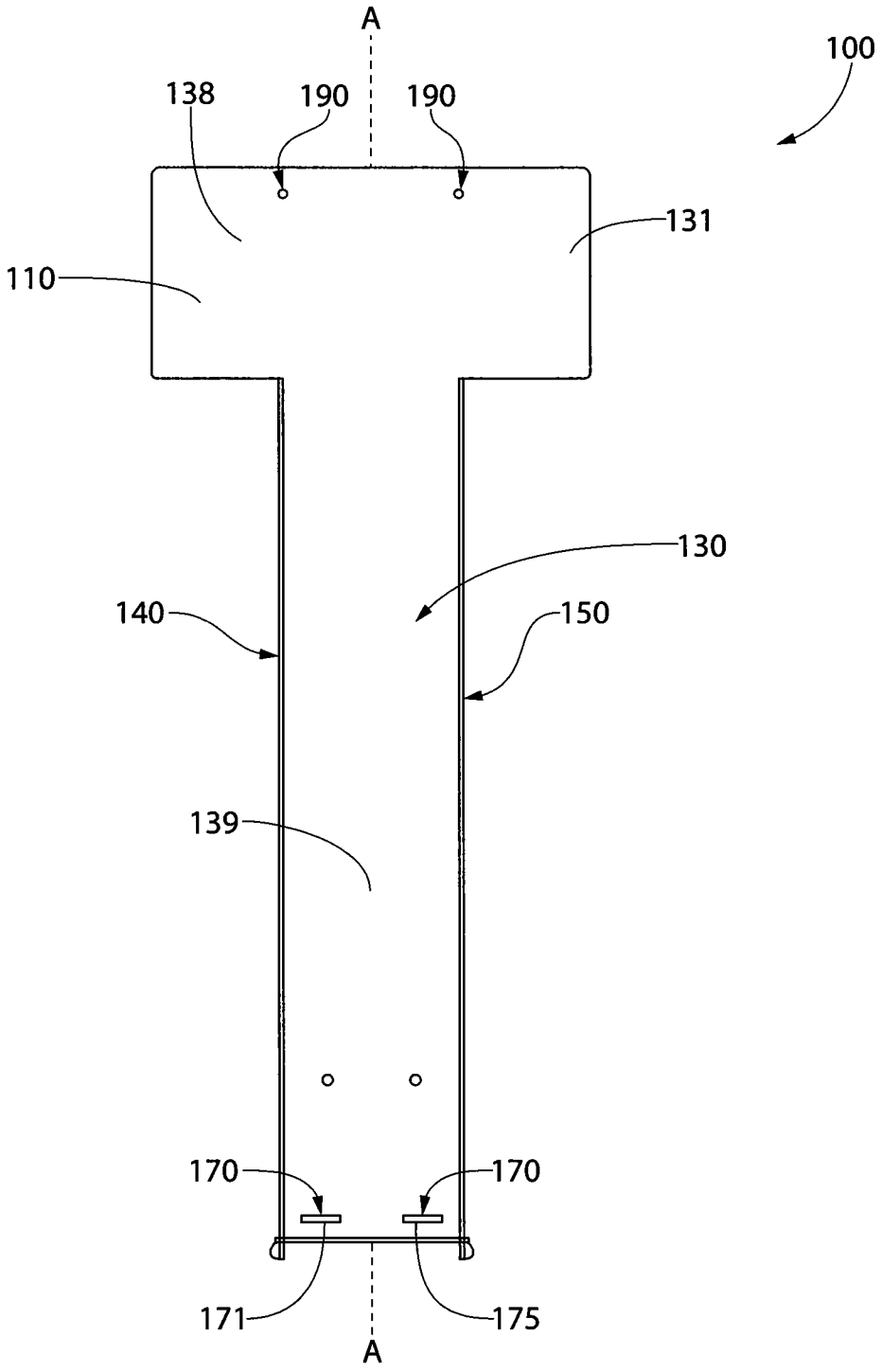
FIG. 4 is a front plan view of the primary display unit of FIG. 3 in an assembled state.

Referring now to FIGS. 2-4, the primary display unit 100 comprises a primary multi-panel structure 110 (also referred to as "primary structure"). The primary structure 110 may comprise a plurality of primary product display apertures 111 (also referred to as "primary apertures"). The primary apertures 111 are configured and arranged on the primary structure 110 to receive and support a plurality of products 900 for display (see FIG. 3B). The primary apertures 111 may be a closed-geometry aperture defined by a primary aperture edge 112.

The primary aperture edge 112 may comprise a floor section 113 opposite a roof section 114. The primary aperture edge 112 may further comprise a front wall section 118 opposite a rear wall section 119. The rear wall section 119 of the primary aperture edge 112 may comprise at least one convex portion 119*a* that extends toward the front wall section 118. The rear wall section 119 of the primary aperture edge 112 may further comprise a first linear portion 119*b* and a second linear portion 119*c*. The convex portion 119*a* of the primary aperture edge 112 may be located between the first and second linear portions 119*b*, 119*c* of the primary aperture edge 112. In such arrangement, the first linear portion 119*b* is offset from the second linear portions 119*c* by the convex portion 119*a*.

The primary aperture edge 112 may further comprise variable production retaining section 120. The variable production retaining section 120 may comprise a first protrusion 121, a second protrusion 123, as well as one or more notches 122 located between the first and second protrusions 121, 123. Together, the first protrusion 121, the second protrusion 123 and the one or more notches 122 of the primary aperture edge 112 define a plurality of product retaining corners that are horizontally and vertically offset from each other. In a non-limiting embodiment, the product retaining section 120 may be located between the front wall section 118 and the floor section 113 of the primary aperture edge 112.

The first protrusion 121 may comprise a first edge 121*a* and a second edge 121*b*. The first edge 121*a* may extend from the front wall section 118 in a first direction. Specifically, the first edge 121*a* may extend from the front wall section 118 in the first direction that is inclined downward from the roof section 114 and toward the rear wall section 119. The second edge 121*b* may extend from the first edge 121*a* in a second direction. Specifically, the second edge 121*b* may extend from the first edge 121*a* in the second direction that declines downward and toward the front wall section 118. The first edge 121*a* may intersect the second edge 121*b* at a first intersection.

The second protrusion 123 may comprise a first edge 123*a*, a second edge 123*b*, and a third edge 123*c*. The first edge 123*a* of the second protrusion 123 may extend from the second edge 121*b* of the first protrusion 121 in a first direction. Specifically, the first edge 123*a* of the second protrusion 123 may extend from the second edge 121*b* of the first protrusion 121 in the first direction that may be parallel to the floor section 113 and extend toward the rear wall section 119. In another embodiment, the first edge 123*a* of the second protrusion 123 may extend from the second edge 121*b* of the first protrusion 121 in the first direction that may decline downward toward the floor section 113 and extend toward the rear wall section 119.

The second edge 123*b* of the second protrusion 123 may extend from the first edge 123*a* of the second protrusion 123 in a second direction. Specifically, the second edge 123*b* may extend from the first edge 123*a* of the second protrusion 123 in the second direction that may decline downward and toward the rear wall section 119. The first edge 123*a* and the second edge 123*b* of the second protrusion 123 may intersect a second intersection.

The third edge 123*c* of the second protrusion 123 may extend from the second edge 123*b* of the second protrusion 123 in a third direction. Specifically, the third edge 123*c* may extend from the second edge 123*b* of the second protrusion 123 in the third direction that may decline downward and toward the front wall section 118. The second edge 123*b* and the third edge 123*c* of the second protrusion 123 may intersect a third intersection.

The first intersection of the first protrusion 121 and the second intersection of the second protrusion 123 may be vertically offset. The first intersection of the first protrusion 121 and the second intersection of the second protrusion 123 may be horizontally offset. The first intersection of the first protrusion 121 and the third intersection of the second protrusion 123 may be vertically offset. The first intersection of the first protrusion 121 and the third intersection of the second protrusion 123 may be horizontally offset. The second intersection of the second protrusion 123 and the third intersection of the second protrusion 123 may be vertically offset. The third intersection of the second protrusion 123 and the second intersection of the second protrusion 123 may be horizontally offset.

The second edge 121*b* of the first protrusion 121 may intersect the first edge 123*a* of the second protrusion to form a fourth intersection. The fourth intersection may form the notch 122. The fourth intersection may be independently vertically offset from each of the first, second, and third intersections. The fourth intersection may be independently horizontally offset from each of the first, second, and third intersections.

The first intersection may be horizontally offset from the front wall 118 by a first distance. The second intersection may be horizontally offset from the front wall 118 by a second distance. The third intersection may be horizontally offset from the front wall 118 by a third distance. The fourth intersection may be horizontally offset from the front wall by a fourth distance. The first distance may be greater than the fourth distance. The second distance may be greater than the fourth distance. The third distance may be greater than the second distance. The second distance may be greater than the first distance. The third distance may be greater than the first distance.

The first intersection may be vertically offset from the floor section 113 by a first height. The second intersection may be vertically offset from the floor section 113 by a second height. The third intersection may be vertically offset from the floor section 113 by a third height. The fourth intersection may be vertically offset from the floor section 113 by a fourth height. The first height may be greater than the fourth height. The second height may be substantially equal to the fourth height. In other embodiments, the second height may be less than the fourth height. The third height may be less than the second height. The second height may be less than the first height. The third height may be less than the first height.

The primary structure 110 may further comprises a hanger element 190. The hanger element 190 may be configured for mounting the primary display unit 100 to a support structure 2—see FIG. 15 (as discussed further herein). The primary structure 110 may further comprises a primary mounting element 170.

The primary structure 110 may comprise a primary rear panel 130 extending along a central vertical axis A-A. The primary rear panel 130 may comprise a front surface 131 opposite a rear surface 132. The primary rear panel 130 may comprise a first side edge 133 and a second side edge 134, the first and second side edges 133, 134 located on opposite sides of the central vertical axis A-A. The primary rear panel 130 may comprise a bottom edge 135 opposite a top edge 136. The central vertical axis A-A may intersect both the bottom edge 135 and the top edge 136 of the primary rear panel 130. The floor section 113 of the primary aperture edge 112 may be substantially orthogonal to the central axis A-A. The primary rear panel 130 further comprising a header section 138 and a central section 139 that extends downward from the header section 138. The header section 138 has a first section width and the central section has a second section width, the first section width being greater than the second section width.

The primary structure 110 of the primary display unit 100 may comprise a primary first side panel 140. The primary structure 110 of the primary display unit 100 may comprise a primary second side panel 150. The primary first side panel 140 and primary second side panel 150 may be located on opposite sides of the central vertical axis A-A. The primary structure 110 of the primary display unit 100 may further comprise a primary floor panel 160.

The primary first side panel 140 may comprise a top edge 143 opposite a bottom edge 144. The primary first side panel 140 may comprise an inner edge 142 opposite an outer edge 141. The inner edge 142 may be substantially parallel to the outer edge 141. The inner edge 142 may intersect the top and bottom edges 143, 144. The outer edge 141 may intersect the top and bottom edges 143, 144. The primary second side panel 150 may comprise a top edge 153 opposite a bottom edge 154. The primary second side panel 150 may comprise an inner edge 152 opposite an outer edge 151. The inner edge 152 may be substantially parallel to the outer edge 151. The inner edge 152 may intersect the top and bottom edges 153, 154. The outer edge 151 may intersect the top and bottom edges 153, 154.

The primary first side panel 140 may further comprise a first floor locking element 146. The first floor locking element 146 may protrude downward from the bottom edge 144 of the primary first side panel 140. The first floor locking element 146 may be coupled to the bottom edge 144 of the primary first side panel 140.

The first floor locking element 146 may be a tab or protuberance that comprises a neck portion 146*a* and head portion 146*b*. The neck portion 146*a* of the first floor locking element 146 may extend downward directly from the bottom edge 144 of the primary first side panel 140. The head portion 146*b* of the first floor locking element 146 may extend downward directly from the neck portion 146*a* of the first floor locking element 146. The neck portion 146*a* of the first floor locking element 146 may have a first width. The head portion 146*b* of the first floor locking element 146 may have a second width. The second width may be equal to or greater than the first width. In a preferred embodiment, the second width may be greater than the first width.

The primary second side panel 150 may further comprise a second floor locking element 156. The second floor locking element 156 may protrude downward from the bottom edge 154 of the primary second side panel 150. The second floor locking element 156 may be coupled to the bottom edge 154 of the primary second side panel 150.

The second floor locking element 156 may be a tab or protuberance that comprises a neck portion 156*a* and head portion 156*b*. The neck portion 156*a* of the second floor locking element 156 may extend downward directly from the bottom edge 154 of the primary second side panel 150. The head portion 156*b* of the second floor locking element 156 may extend downward directly from the neck portion 156*a* of the second floor locking element 156. The neck portion 156*a* of the second floor locking element 156 may have a first width, and the head portion 156*b* of the second floor locking element 156 may have a second width. The second width may be equal to or greater than the first width. In a preferred embodiment, the second width may be greater than the first width.

The primary first side panel 140 may be coupled to the first side edge 133 of the primary rear panel 130 and extend from the front surface 131 of the primary rear panel 130. The primary second side panel 150 may be coupled to the second side edge 134 of the primary rear panel 130 and extend from the front surface 131 of the primary rear panel 130. The primary rear panel 130 may be coupled to the inner edge 142 of the primary first side panel 140. The primary rear panel 130 may be coupled to the inner edge 152 of the primary second side panel 150.

The central section 139 of the primary rear panel 130 may comprise the first and second side edges 133, 134, whereby the primary first side panel 140 may be coupled to the central section 139 at the first side edge 133 and the primary second side panel 150 may be coupled to the central section 139 at the second side edge 134.

The primary first side panel 140 may comprise a first set of product display apertures 145. The first set of product display apertures 145 may form at least a portion of the primary apertures 111 of the primary display unit 100. The primary second side panel 150 may comprise a second set of product display apertures 155. The second set of product display apertures 155 may form at least a portion of the primary apertures 111 of the primary display unit 100.

The primary floor panel 160 may comprise an upper surface 161 opposite a lower surface 162. The primary floor panel 160 may comprise an inner edge 164 opposite an outer edge 163. The primary floor panel may further comprise side edges 165 extending between the inner edge 164 and the outer edge 163.

The primary floor panel 160 may be coupled to the bottom edge 135 of the primary rear panel 130. The primary floor panel 160 may extend from the front surface 131 of the primary rear panel 130. The primary floor panel 160 may comprise locking elements 166 that may be configured to engage at least one of the first and/or second floor locking elements 146, 156. In a non-limiting embodiment, the locking elements 166 may be a slot that extends between the upper surface 161 and the lower surface 162 of the primary floor panel 160. The slot may have a third width. The third width of the slot 166 may be less than second width of the head portion 146*b*, 156*b* of first floor locking element 146, and/or the second floor locking element 156. The third width of the slot 166 may be greater than first width of the neck portion 146*a*, 156*a* of first floor locking element 146, and/or the second floor locking element 156.

The locking elements 166 may comprise a first locking element 166*a* and a second locking element 166*b*. The first locking element 166*a* and the second locking element 166*b* may be located on opposite sides of the central axis A-A. Each of the first and second locking elements 166*a*, 166*b* may be a slot.

The slot of the first locking element 166*a* may have a third width that is greater than the first width of neck portion 146*a* of the first locking element 146. The slot of the first locking element 166*a* may have a third width that is less than the second width of head portion 146*b* of the first locking element 146.

The slot of the second locking element 166*b* may have a third width that is greater than the first width of neck portion 156*a* of the second locking element 156. The slot of the first locking element 166*a* may have a third width that is less than the second width of head portion 156*b* of the second locking element 156.

The primary structure 110 may comprise a first pre-weakened line 115. The first pre-weakened line 115 may be located at the first side edge 133 of the primary rear panel 130. The first pre-weakened line 115 may be located at the first inner edge 142 of the primary first panel 140. The first pre-weakened line 115 may overlap the first inner edge 142 of the primary first panel 140 and the first side edge 133 of the primary rear panel 130.

The primary structure 110 may comprise a second pre-weakened line 116. The second pre-weakened line 116 may be located at the second side edge 134 of the primary rear panel 130. The second pre-weakened line 116 may be located at the first inner edge 152 of the primary second panel 150. The second pre-weakened line 116 may overlap the first inner edge 152 of the primary second panel 150 and the second side edge 134 of the primary rear panel 130.

The primary structure 110 may comprise a third pre-weakened line 117. The third pre-weakened line 117 may be located at the bottom edge 135 of the primary rear panel 130. The third pre-weakened line 117 may be located between the bottom edge 135 of the primary rear panel 130 and the primary floor panel 160.

The side edges 165 may comprise a first side edge 165*a* that extends between the inner edge 164 and the outer edge 163 of the primary floor panel 160 and is located adjacent to the first pre-weakened line 115 of the primary structure 110. The side edges 165 may comprise a second side edge 165*b* that extends between the inner edge 164 and the outer edge 163 of the primary floor panel 160 and is located adjacent to the first second-weakened line 116 of the primary structure 110. The first and second side edges 165*a*, 165*b* may be located on opposite sides of the central axis A-A.

Referring now to FIG. 2, the primary display unit 100 may be supplied in an unassembled state, whereby the primary first side panel 140 may be flat relative to the primary rear panel 130. Stated otherwise, in the unassembled state, the primary first side panel 140 may be substantially coplanar with to the primary rear panel 130. The unassembled state may also be referred to "blank" or a "blank sheet." In the unassembled state, the primary second side panel 150 may be flat relative to the primary rear panel 130. Stated otherwise, in the unassembled state, the primary second side panel 150 may be substantially coplanar with to the primary rear panel 130. In the unassembled state, the primary floor panel 160 may be flat relative to the primary rear panel 130. Stated otherwise, in the unassembled state, the primary floor panel 160 may be substantially coplanar with to the primary rear panel 130. The primary display unit 100 may be a flat sheet in the unassembled state—whereby the flat sheet is substantially planar.

In the unassembled state, the upper surface 161 of the primary floor panel 160 may face the same direction as the front surface 131 of the primary rear panel 130. In the unassembled state, the lower surface 162 of the primary floor panel 160 may face the same direction as the rear surface 132 of the primary rear panel 130.

Referring now to FIGS. 3 and 4, the primary display unit 100 may converted from the unassembled state to an assembled state, whereby the primary first side panel 140 is bent relative to the primary rear panel 130. Stated otherwise, in the assembled state, the primary first side panel 140 may be non-coplanar with to the primary rear panel 130. The primary first side panel 140 may be bent relative to the primary rear panel 130 along the first pre-weakened line 115. In the assembled state, the primary first side panel 140 may substantially orthogonal to the primary rear panel 130.

The primary display unit 100 may also be converted from the unassembled state to an assembled state such that the primary second side panel 150 is bent relative to the primary rear panel 130. Stated otherwise, in the assembled state, the primary second side panel 150 may be non-coplanar with to the primary rear panel 130. The primary second side panel 150 may be bent relative to the primary rear panel 130 along the second pre-weakened line 116. In the assembled state, the primary second side panel 150 may substantially orthogonal to the primary rear panel 130. In the assembled state, the primary first and second side panels 140, 150 may be substantially parallel.

The primary display unit 100 may also be converted from the unassembled state to an assembled state such that the primary floor panel 160 is bent relative to the primary rear panel 130. Stated otherwise, in the assembled state, the primary floor panel 160 may be non-coplanar with to the primary rear panel 130. The primary floor panel 160 may be bent relative to the primary rear panel 130 along the third pre-weakened line 117. In the assembled state, the primary floor panel 160 may substantially orthogonal to the primary rear panel 130. In the assembled state, the primary floor panel 160 may be substantially orthogonal to each of the first and second side panels 140, 150.

The primary rear panel 130 and the primary first side panel 140 may be formed from a single continuous sheet of material. The primary rear panel 130 and the primary second side panel 150 may be formed from a single continuous sheet of material. The primary rear panel 130 and the primary floor panel 160 may be formed from a single continuous sheet of material. The primary rear panel 130, the primary first side panel 140, and the primary second side panel 150 may be formed from a single continuous sheet of material. The primary rear panel 130, the primary first side panel 140, the primary second side panel 150, and the primary floor panel 160 may be formed from a single continuous sheet of material.

The material that may form the primary rear panel 130, the primary first side panel 140, and the primary second side panel 150 may be a polymeric material. In a non-limiting example, the polymeric material may be a polyester polymer, a polyurethane polymer, an acrylic polymer, a vinyl polymer, and the like. The material may be at least partially transparent. In some embodiments, the material may be completely transparent. In other embodiments, the material may be substantially opaque. In some embodiments, the material may be translucent. In some embodiments, the material may be colored by adding a pigment or dye to the material, thereby causing the material to exhibit a color on the visible spectrum.

For the purposes of this application, the phrases "substantially clear" or "substantially transparent" refers to materials that have the property of transmitting light in such a way that a normal, human eye (i.e., one belonging to a person with so-called "20/20" vision) or a suitable viewing device can see through the material distinctly. The level of transparency should generally be one which permits a normal, human eye to distinguish objects having length and width on the order of at least 0.5 inches and should not significantly distort the perceived color of the original object. The material should be substantially clear (or substantially transparent) such that the products 900 positioned in the primary display unit 100 can be visible from any unhindered position relative to the primary display unit 100.

Figure 3C:
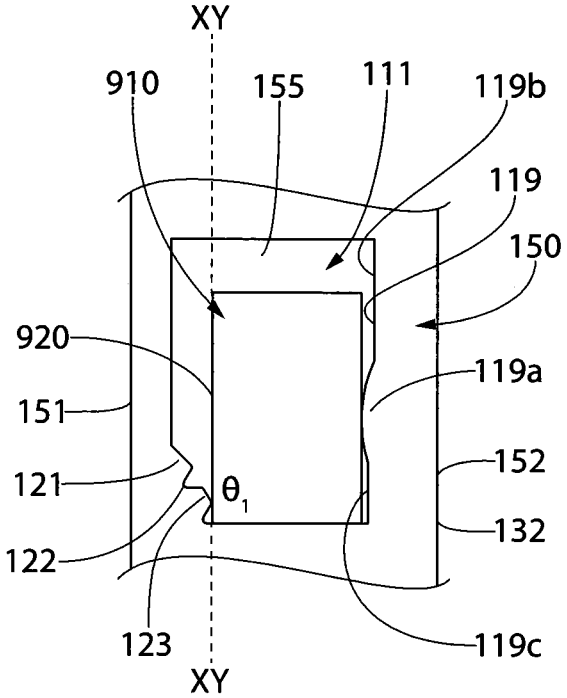
FIG. 3C is a close-up plan sideview of area IIIC of the primary display unit of FIG. 3B in an assembled state with a package inserted therein.

Referring now to FIGS. 3-3C, a plurality of first products 900 may be inserted through the primary product display apertures 111. The plurality of first products 900 may be positioned within the primary product display apertures 111 and supported by the primary structure 110—as discussed in greater detail herein.

Each of the first products 900 may comprise a package 910 having a product display surface 920. The primary product display apertures 111 may be configured and arrange to support the first products 900 such that the product display surface 920 of the first products 900 are oriented at a first angle $Ø_1$ relative to a vertical plane X-Y. The vertical plane X-Y may be substantially parallel to the rear surface 132 of the primary rear panel 130. The first angle $Ø_1$ may be 0°. In some embodiments, the first angle $Ø_1$ may range from 0° to about 1°. In a preferred embodiment, the first angle $Ø_1$ is substantially 0°. The phrase "substantially 0°" refers to the product display surface 920 of the first packages 900 being substantially vertical. In a non-limiting example, the first angle $Ø_1$ is substantially 0° such that the product display surface 920 is substantially parallel to the rear surface 132 of the primary rear panel 130.

Each of the first packages 910 may comprise a box. Although not shown, the box may contain an oral care product. Non-limiting examples of oral care product include toothpaste, mouth wash, toothbrush, tooth whitening agent, and the like. The product display surface 920 of each box (first package 910) may comprise indicia indicative of the oral care product contained within the first package 910. Non-limiting examples of indicia include text, pictures, and various color and pattern combinations.

The package 910 may be inserted through the primary product display apertures 111 such that at least one of the first and/or second protrusions 121, 123 contact the product display surface 920 of the package 910. In one embodiment, the second intersection may contact the product display surface 920 and the surface of the package opposite the product display surface (i.e., a rear surface) may contact the convex portion 119*a* of the rear wall section 119.

As described further herein, different sized packages 910 may be inserted through the primary product display apertures 111, where by the first and/or second protrusions may support the different sized packages 910.

Referring now to FIGS. 3B and 3C, a plurality of the first products 900 may be positioned in the primary display unit 100 by extending through the first set of product display apertures 145 of the primary first side panel 140 and the second set of product display apertures 155 of the primary second side panel 150. In this arrangement, the first products 900 may be supported by the first side panel 140 and the second side panel 150 so that middle portions 901 of the first products 900 are located between the primary first side panel 140 and the primary second side panel 150. Additionally, in this arrangement, first end portions 901 of the first products 900 protrude from the first side panel 140 in a first direction, and second end portions 902 of the first products 900 protrude from the second side panel 150 in a second direction that is opposite the first direction.

As discussed, the primary structure 110 may comprise a primary mounting element 170 that is configured to engage one or more add-on display units 200. The primary mounting element 170 may be located on the primary rear panel 130. The primary mounting element 170 may be located toward the bottom of the primary rear panel 130 adjacent to the primary floor panel 160. The primary mounting element 170 may be a slot that extends from the front surface 131 to the rear surface 132 of the primary rear panel 130. In other embodiments, the primary mounting element 170 may be a tab, hole for receiving a pin, a pin, a hook, a clamp, and the like.

In a non-limiting example, the primary mounting element 170 may be the slot that extends between the front surface 131 and the rear surface 131 of the primary rear panel 130. The slot may have a fourth width.

The primary mounting element 170 may be configured to engage one or more add-on mounting elements 220 of the add-on display units 200—as discussed further herein. The primary mounting element 170 may comprise a first primary mounting element 171. The primary mounting element 170 may comprise a second primary mounting element 175. The first primary and second primary mounting elements 171, 175 may be located on opposite sides of the central vertical axis A-A. In other embodiments, the primary mounting element 170 may be centered on the primary rear panel 130 such that the central vertical axis A-A intersects at least a portion of the primary mounting element 170.

Figure 5:
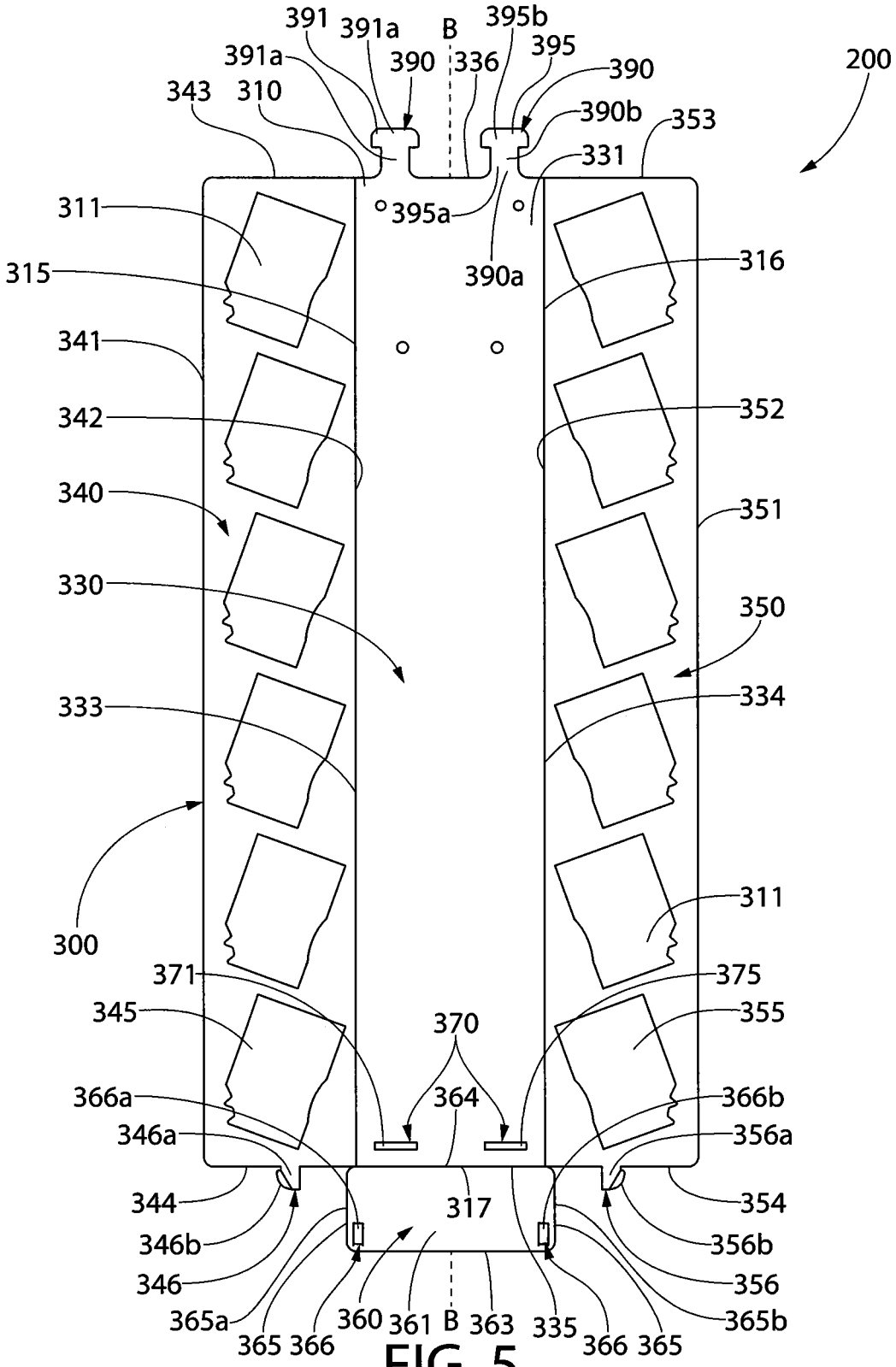
FIG. 5 is a front plan view of a first add-on display unit in an unassembled state.
Figure 6:
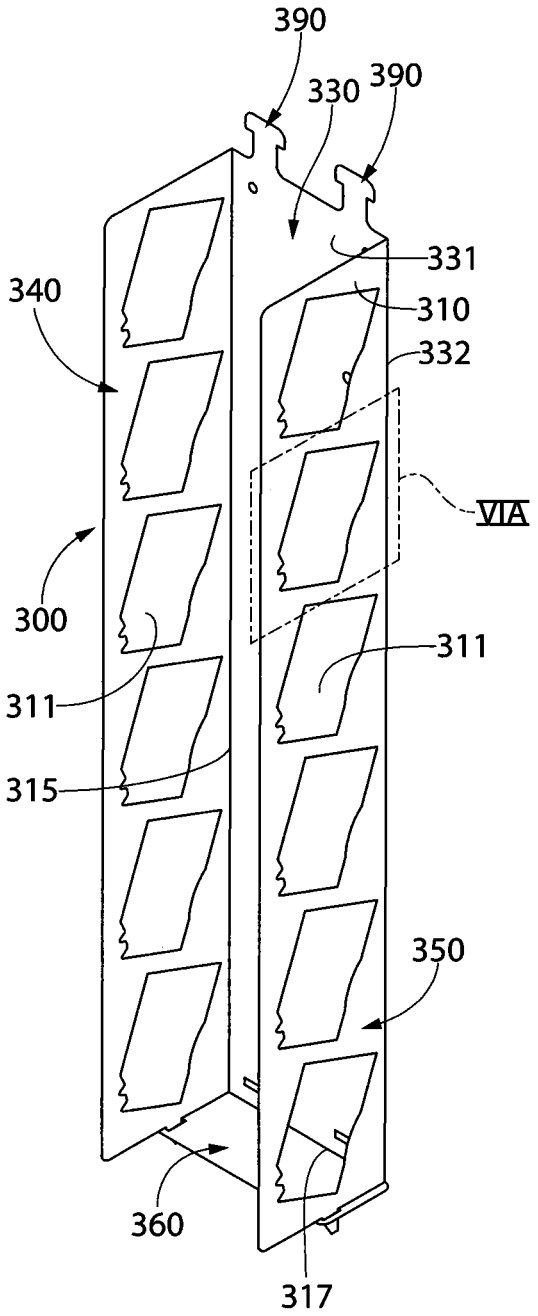
FIG. 6 is a front perspective view of the first add-on display unit of FIG. 5 in an assembled state.
Figure 6A:
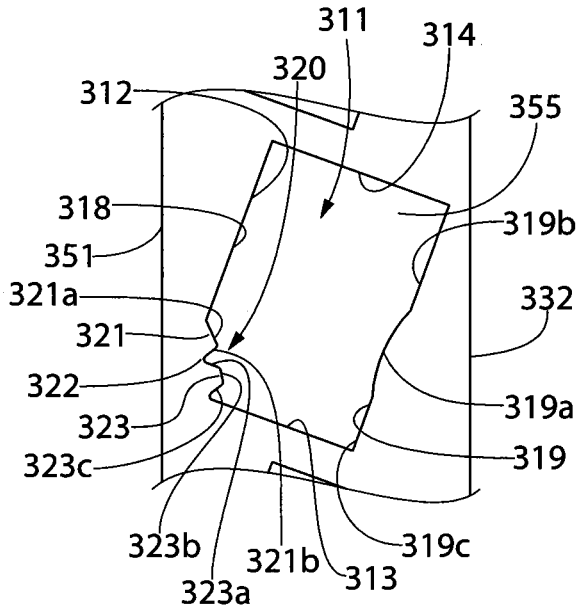
FIG. 6A is a close-up plan sideview of area VIA of the primary display unit of FIG. 6 in an assembled state.
Figure 6B:
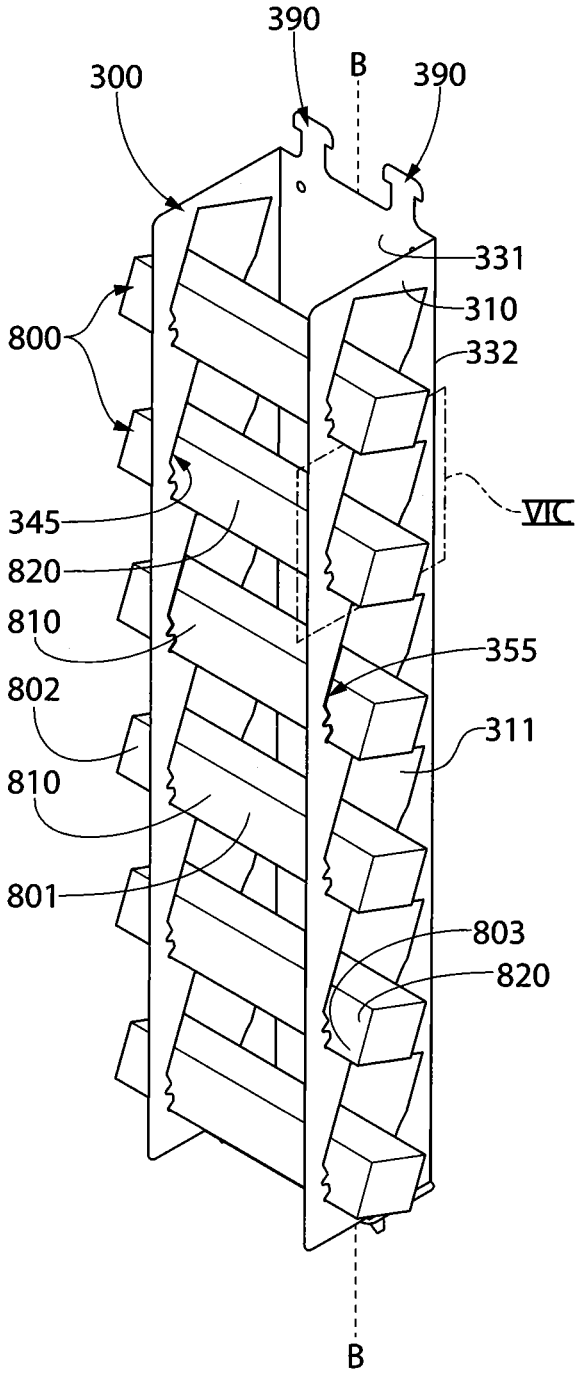
FIG. 6B is a front perspective view of the primary display unit of FIG. 6A with a plurality of packages inserted therein.
Figure 6C:
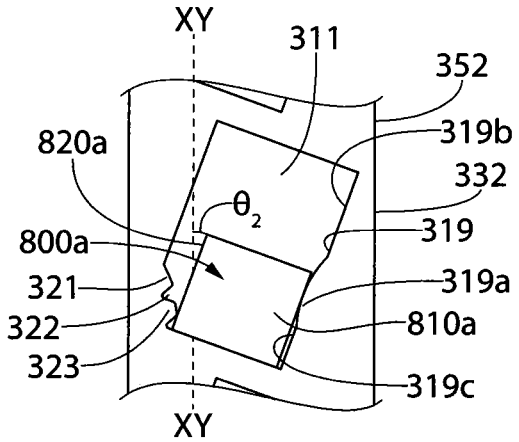
FIG. 6C is a close-up plan sideview of area VIC of the primary display unit of FIG. 6B in an assembled state with a package according to one embodiment inserted therein.
Figure 6D:
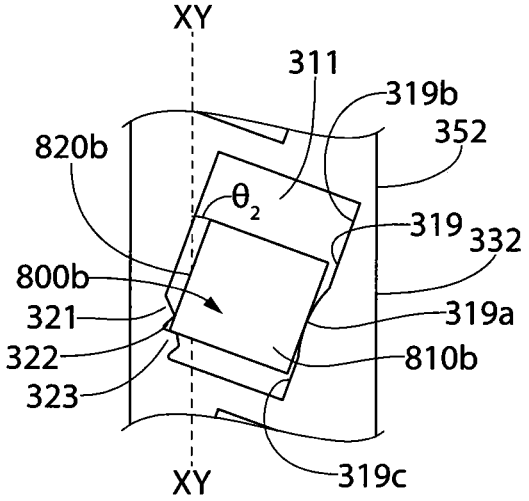
FIG. 6D is a close-up plan sideview of area VIC of the primary display unit of FIG. 6B in an assembled state with a second package according to one embodiment inserted therein.
Figure 6E:
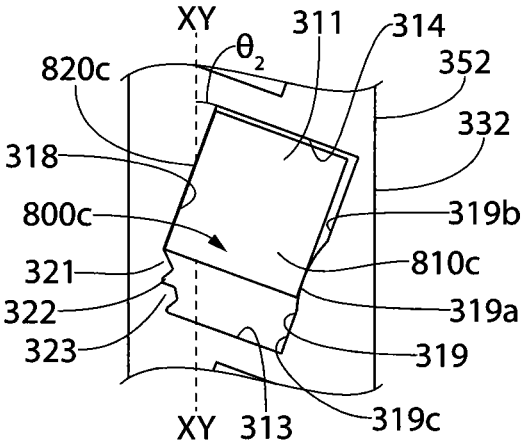
FIG. 6E is a close-up plan sideview of area VIC of the primary display unit of FIG. 6B in an assembled state with a third package according to one embodiment inserted therein.
Figure 7:
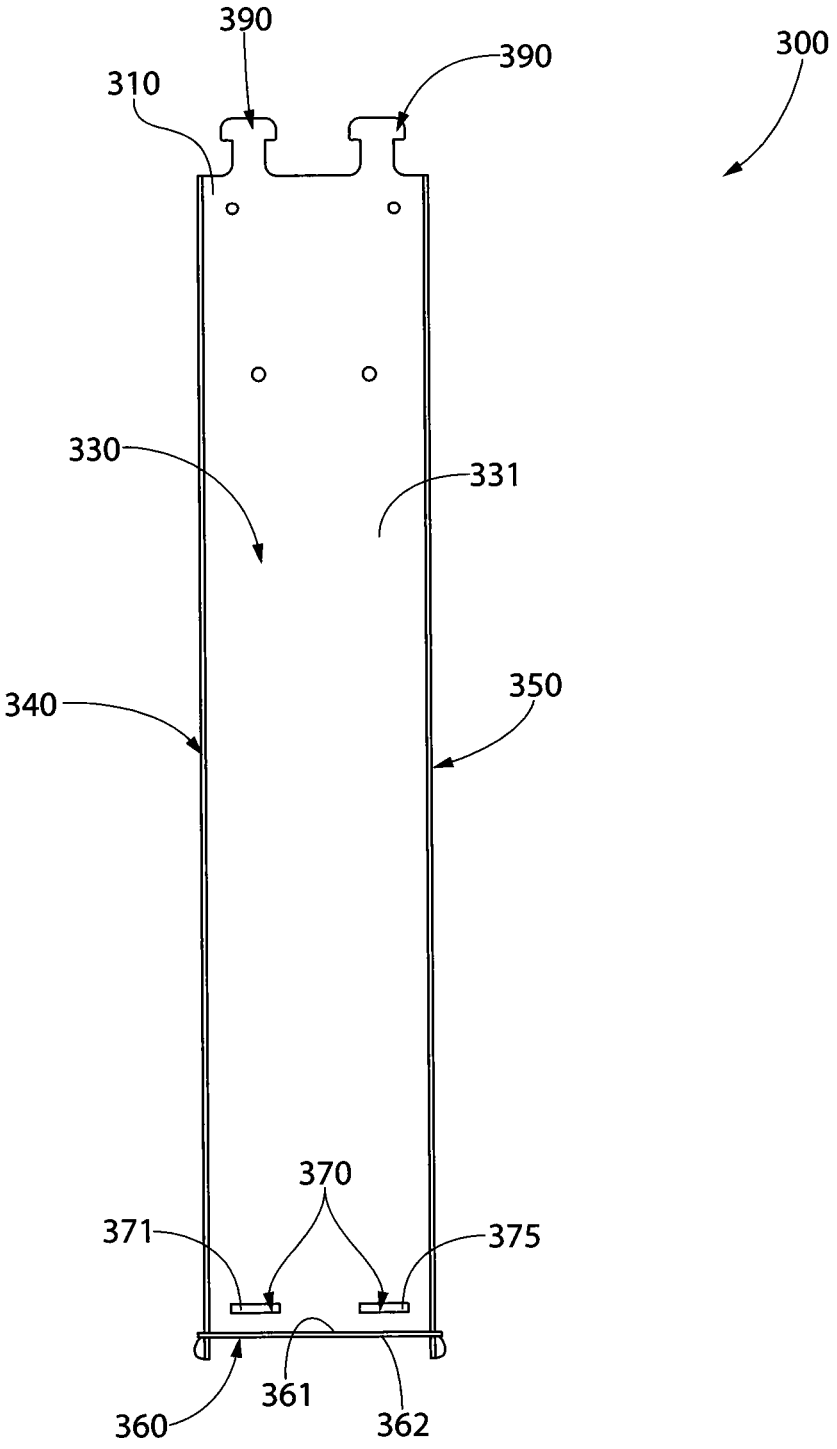
FIG. 7 is a front plan view of the first add-on display unit of FIG. 6 in an assembled state.

Referring now to FIGS. 5-7, the add-on display unit 200 may comprise a first add-on display unit 300. The first add-on display unit 300 may comprises a first add-on structure 310. The first add-on structure 310 may comprise a plurality of add-on product display apertures 311. The add-on product display apertures 311 are configured and arranged on the first add-on structure 310 to receive and support a plurality of second products 800 for display (see FIG. 6B-6E). The add-on product display apertures 311 may be a closed-geometry aperture defined by an add-on aperture edge 312.

The add-on aperture edge 312 may comprise a floor section 313 opposite a roof section 314. The add-on aperture edge 312 may further comprise a front wall section 318 opposite a rear wall section 319. The rear wall section 119 of the add-on aperture edge 12 may comprise at least one convex portion 319*a* that extends toward the front wall section 318. The rear wall section 319 of the primary aperture edge 312 may further comprise a first linear portion 319*b* and a second linear portion 319*c*. The convex portion 319*a* of the add-on aperture edge 312 may be located between the first and second linear portions 319*b*, 119*c* of the add-on aperture edge 312. In such arrangement, the first linear portion 319*b* is offset from the second linear portions 319*c* by the convex portion 319*a*.

The add-on aperture edge 312 may further comprise variable production retaining section 320. The variable production retaining section 320 may comprise a first protrusion 321, a second protrusion 323, as well as one or more notches 322 located between the first and second protrusions 321, 323. Together, the first protrusion 321, the second protrusion 323 and the one or more notches 322 of the add-on aperture edge 312 define a plurality of product retaining corners that are horizontally and vertically offset from each other. In a non-limiting embodiment, the product retaining section 320 may be located between the front wall section 318 and the floor section 313 of the add-on aperture edge 312.

The first protrusion 321 may comprise a first edge 321*a* and a second edge 321*b*. The first edge 321*a* may extend from the front wall section 318 in a first direction. Specifically, the first edge 321*a* may extend from the front wall section 318 in the first direction that is inclined downward and toward the floor section 313 facing the rear wall section 319. The second edge 321*b* may extend from the first edge 321*a* in a second direction. Specifically, the second edge 321*b* may extend from the first edge 321*a* in the second direction that declines downward toward the floor section 313 and forward toward the front wall section 318. The first edge 321*a* may intersect the second edge 321*b* at a first intersection.

The second protrusion 323 may comprise a first edge 323*a*, a second edge 323*b*, and a third edge 323*c*. The first edge 323*a* of the second protrusion 323 may extend from the second edge 321*b* of the first protrusion 321 in a first direction. Specifically, the first edge 323*a* of the second protrusion 323 may extend from the second edge 321*b* of the first protrusion 321 in the first direction that may be parallel to the floor section 313 and extend outward from the second edge 321*b* of the first protrusion 321 toward the rear wall section 319. In another embodiment, the first edge 323*a* of the second protrusion 323 may extend from the second edge 321*b* of the first protrusion 321 in the first direction that may decline downward toward the floor section 313 and extend toward the rear wall section 319.

The second edge 323*b* of the second protrusion 323 may extend from the first edge 323*a* of the second protrusion 323 in a second direction. Specifically, the second edge 323*b* may extend from the first edge 323*a* of the second protrusion 323 in the second direction that declines downward toward the rear wall section 319. The first edge 323*a* and the second edge 323*b* of the second protrusion 323 may intersect a second intersection.

The third edge 323*c* of the second protrusion 323 may extend from the second edge 323*b* of the second protrusion 323 in a third direction. Specifically, the third edge 323*c* may extend from the second edge 323*b* of the second protrusion 323 in the third direction that declines downward toward the front wall section 318. The second edge 323*b* and the third edge 323*c* of the second protrusion 323 may intersect a third intersection.

The first intersection of the first protrusion 321 and the second intersection of the second protrusion 323 may be vertically offset. The first intersection of the first protrusion 321 and the second intersection of the second protrusion 323 may be horizontally offset. The first intersection of the first protrusion 321 and the third intersection of the second protrusion 323 may be vertically offset. The first intersection of the first protrusion 321 and the third intersection of the second protrusion 323 may be horizontally offset. The second intersection of the second protrusion 323 and the third intersection of the second protrusion 323 may be vertically offset. The third intersection of the second protrusion 323 and the second intersection of the second protrusion 323 may be horizontally offset.

The second edge 321*b* of the first protrusion 321 may intersect the first edge 323*a* of the second protrusion to form a fourth intersection. The fourth intersection may form the notch 322. The fourth intersection may be independently vertically offset from each of the first, second, and third intersections. The fourth intersection may be independently horizontally offset from each of the first, second, and third intersections.

The first intersection may be horizontally offset from the front wall 318 by a first distance. The second intersection may be horizontally offset from the front wall 318 by a second distance. The third intersection may be horizontally offset from the front wall 318 by a third distance. The fourth intersection may be horizontally offset from the front wall 318 by a fourth distance. The first distance may be greater than the fourth distance. The second distance may be greater than the fourth distance. The third distance may be greater than the second distance. The second distance may be greater than the first distance. The third distance may be greater than the first distance.

The first intersection may be vertically offset from the floor section 313 by a first height. The second intersection may be vertically offset from the floor section 313 by a second height. The third intersection may be vertically offset from the floor section 313 by a third height. The fourth intersection may be vertically offset from the floor section 313 by a fourth height. The first height may be greater than the fourth height. The second height may be substantially equal to the fourth height. In other embodiments, the second height may be less than the fourth height. The third height may be less than the second height. The second height may be less than the first height. The third height may be less than the first height.

The first add-on structure 310 may further comprises an upper mounting element 390. The upper mounting element 390 may be located at top portion of the add-on structure 310. The upper mounting element 390 may extend from the top edge 336 of the add-on rear panel 330.

Figure 10:
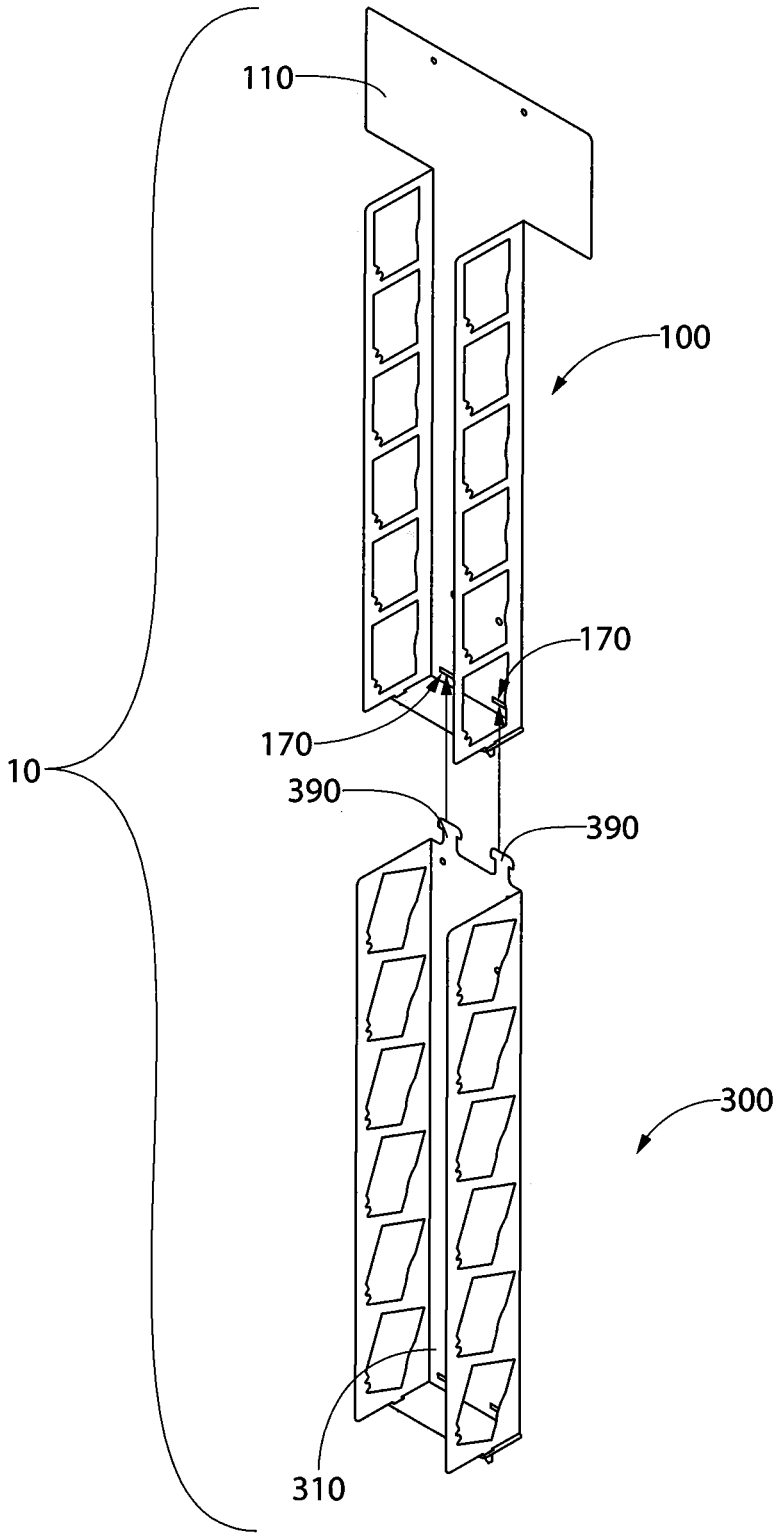
FIG. 10 is a front perspective view of a modular point-of-sale display in an unassembled state according to one embodiment of the present invention.
Figure 11:
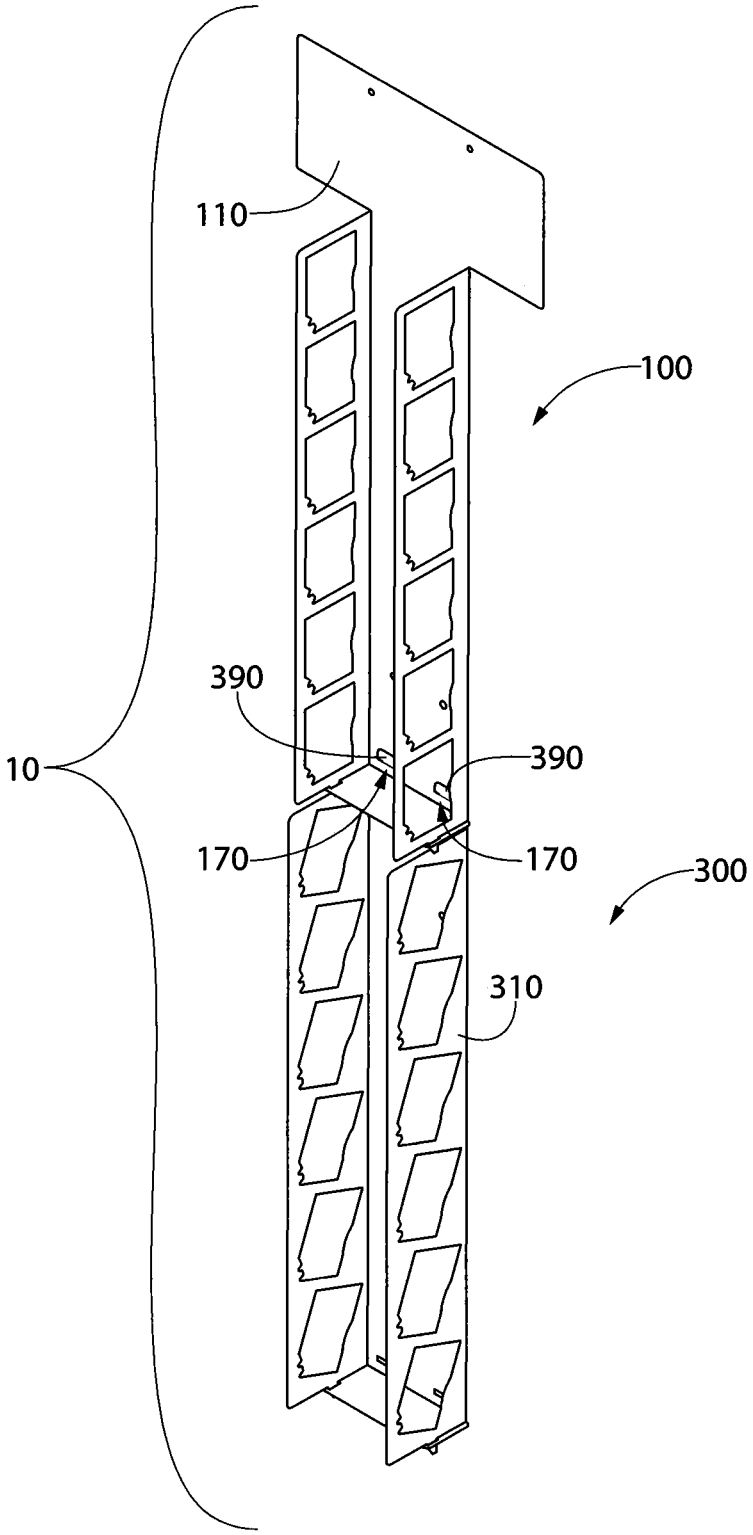
FIG. 11 is a front perspective view of the modular point-of-sale display of FIG. 10 in an assembled state.
Figure 12:
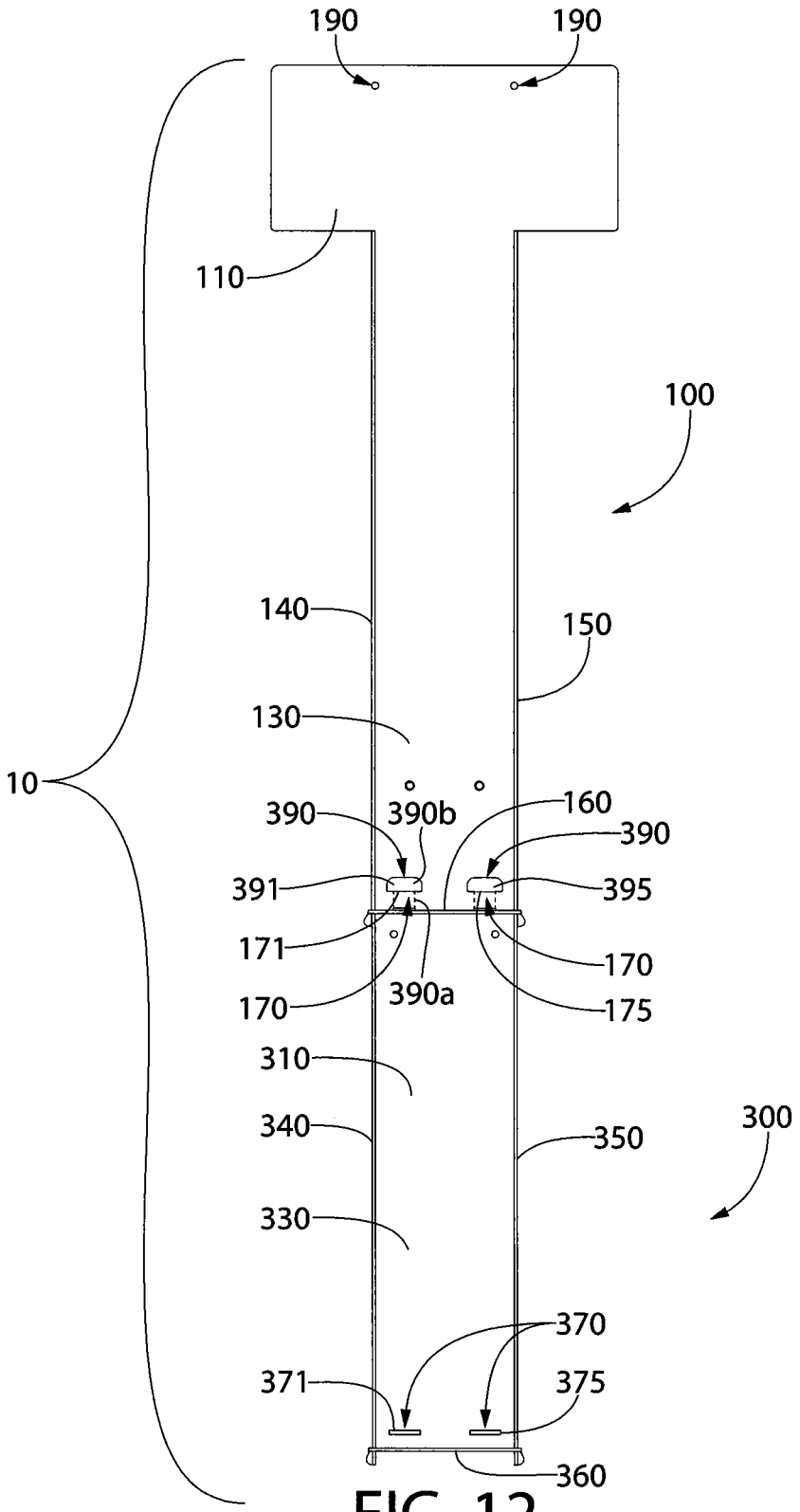
FIG. 12 is a front plan view of the modular point-of-sale display of FIG. 10 in an assembled state.
Figure 13:
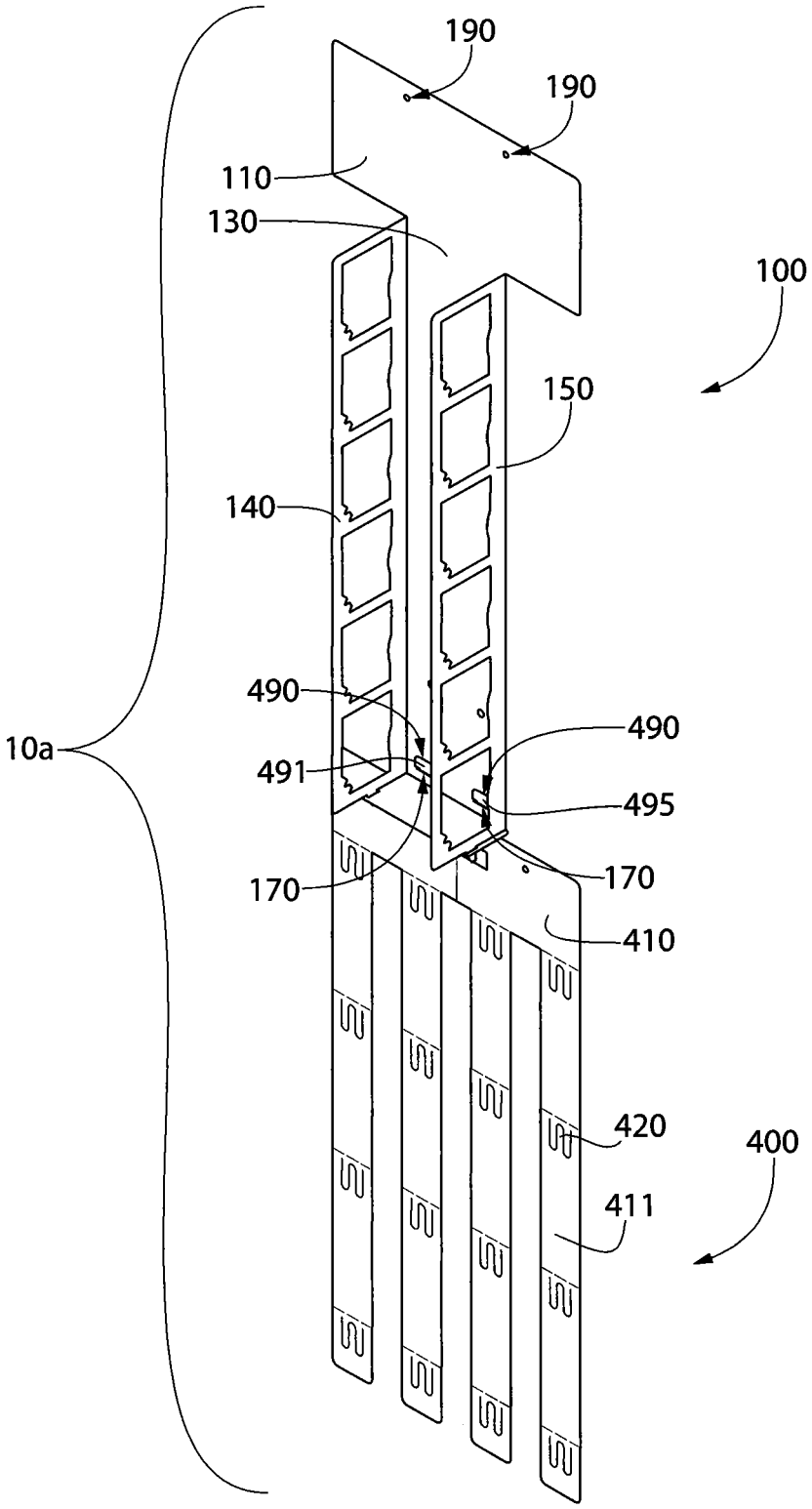
FIG. 13 is a front perspective view of a modular point-of-sale display in an assembled state according to another embodiment of the present invention.
Figure 14:
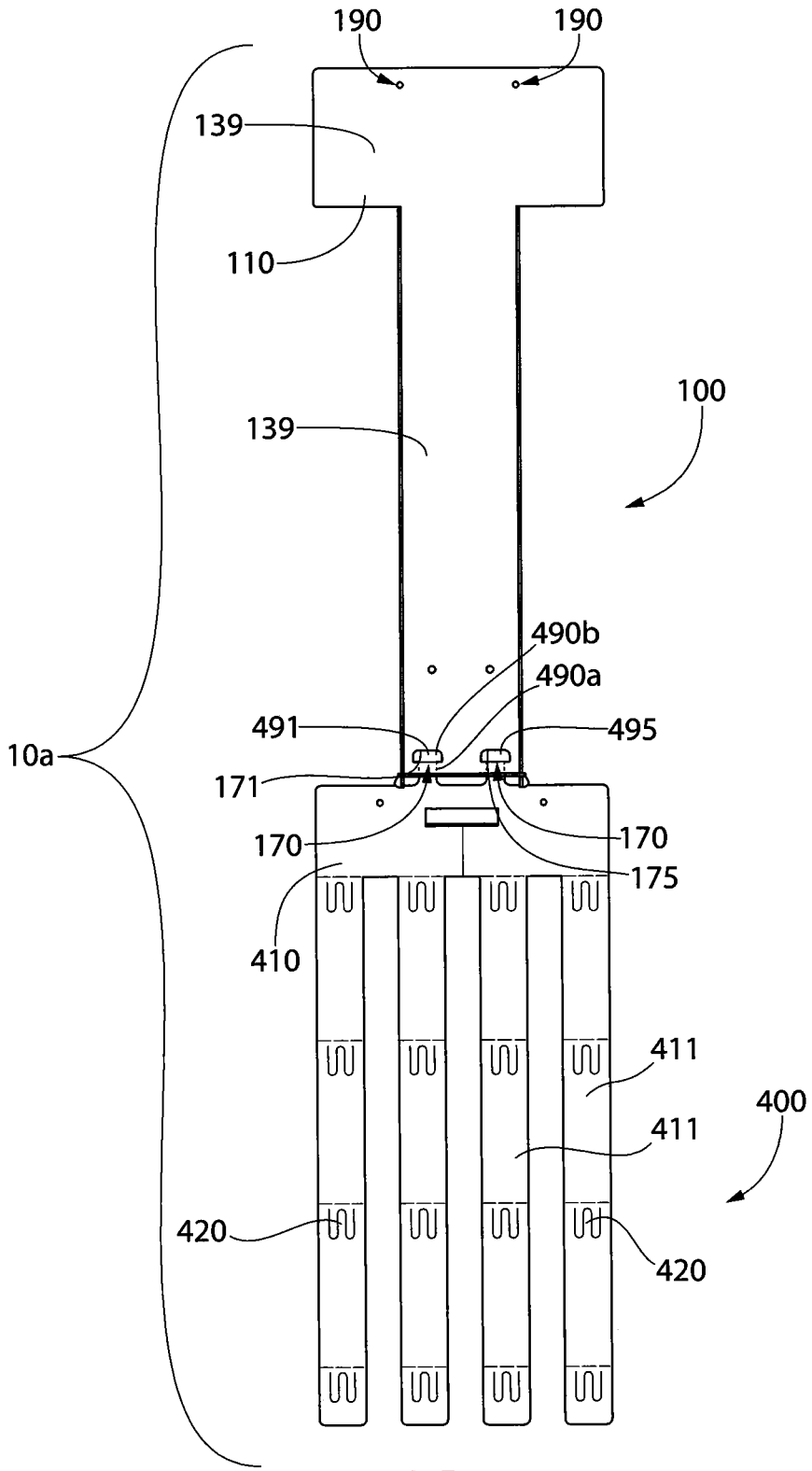
FIG. 14 is a front plane view of the modular point-of-sale display of FIG. 13.

As discussed in greater detail herein, the upper mounting element 390 may be configured for hanging the first add-on display unit 300 to the primary display unit 100 via the primary mounting element 170—i.e., hanging the first add-on display unit 300 from the primary display unit 100 via an engagement between the upper mounting element 390 of the add-on display unit and the mounting element 170 of the primary display unit 100—see FIGS. 10 and 11 (as discussed further herein).

The first add-on structure 310 may comprise an add-on rear panel 330 extending along a second central vertical axis B-B. The add-on rear panel 330 may comprise a front surface 331 opposite a rear surface 332. The add-on rear panel 330 may comprise a first side edge 333 and a second side edge 334, the first and second side edges 333, 334 located on opposite sides of the second central vertical axis B-B. The add-on rear panel 330 may comprise a bottom edge 335 opposite a top edge 336. The second central vertical axis B-B may intersect both the bottom edge 335 and the top edge 336 of the add-on rear panel 330. The floor section 313 of the add-on aperture edge 312 may be inclined relative to the second central axis B-B. Specifically, the floor section 313 of the add-on aperture edge 312 may be downwardly inclined moving from the front wall section 318 to the rear wall section 319.

The first add-on structure 310 of the first add-on display unit 300 may comprise an add-on first side panel 340. The first add-on structure 310 of the first add-on display unit 300 may comprise an add-on second side panel 350. The add-on first side panel 340 and the add-on second side panel 350 may be located on opposite sides of the second central vertical axis B-B. The first add-on structure 310 of the first add-on display unit 300 may further comprise an add-on floor panel 360.

The add-on first side panel 340 may comprise a top edge 343 opposite a bottom edge 344. The add-on first side panel 340 may comprise an inner edge 342 opposite an outer edge 141. The inner edge 342 of the add-on first side panel 340 may be substantially parallel to the outer edge 341 of the add-on first side panel 340. The inner edge 342 of the add-on first side panel 340 may intersect the top and bottom edges 343, 344 of the add-on first side panel 340. The outer edge 341 of the add-on first side panel 340 may intersect the top and bottom edges 343, 344 of the add-on first side panel 340.

The add-on second side panel 350 may comprise a top edge 353 opposite a bottom edge 354. The add-on second side panel 350 may comprise an inner edge 352 opposite an outer edge 351. The inner edge 352 of the add-on second side panel 350 may be substantially parallel to the outer edge 351 of the add-on second side panel 350. The inner edge 352 of the add-on second side panel 350 may intersect the top and bottom edges 353, 354 of the add-on second side panel 350. The outer edge 351 of the add-on second side panel 350 may intersect the top and bottom edges 353, 354 of the add-on second side panel 350.

The add-on first side panel 340 may further comprise a first floor locking element 346. The first floor locking element 346 of the add-on first side panel 340 may protrude downward from the bottom edge 344 of the add-on first side panel 340. The first floor locking element 346 of the add-on first side panel 340 may be coupled to the bottom edge 344 of the add-on first side panel 340.

The first floor locking element 346 may be a tab or protuberance that comprises a neck portion 346*a* and head portion 346*b*. The neck portion 346*a* of the first floor locking element 346 may extend downward directly from the bottom edge 344 of the add-on first side panel 340. The head portion 346*b* of the first floor locking element 346 may extend downward directly from the neck portion 346*a* of the first floor locking element 346. The neck portion 346*a* of the first floor locking element 346 may have a first width. The head portion 346*b* of the first floor locking element 346 may have a second width. The second width may be equal to or greater than the first width for the first floor locking element 346 of the add-on first side panel 340. In a preferred embodiment, the second width may be greater than the first width for the first floor locking element 346 of the add-on first side panel 340.

The add-on second side panel 350 may further comprise a second floor locking element 356. The second floor locking element 356 of the add-on second side panel 350 may protrude downward from the bottom edge 354 of the add-on second side panel 350. The second floor locking element 356 of the add-on second side panel 350 may be coupled to the bottom edge 354 of the add-on second side panel 350.

The second floor locking element 356 may be a tab or protuberance that comprises a neck portion 356*a* and head portion 356*b*. The neck portion 156*a* of the second floor locking element 156 may extend downward directly from the bottom edge 354 of the add-on second side panel 350. The head portion 356*b* of the second floor locking element 356 of the add-on second side panel 350 may extend downward directly from the neck portion 356*a* of the second floor locking element 356 of the add-on second side panel 350. The neck portion 356*a* of the second floor locking element 356 of the add-on second side panel 350 may have a first width, and the head portion 356*b* of the second floor locking element 156 of the add-on second side panel 350 may have a second width. The second width may be equal to or greater than the first width for the add-on second side panel 350. In a preferred embodiment, the second width may be greater than the first width for the add-on second side panel 350.

The add-on first side panel 340 may be coupled to the first side edge 333 of the add-on rear panel 330 and extend from the front surface 331 of the add-on rear panel 330. The add-on second side panel 350 may be coupled to the second side edge 334 of the add-on rear panel 330 and extend from the front surface 331 of the add-on rear panel 330. The add-on rear panel 330 may be coupled to the inner edge 342 of the add-on first side panel 340. The add-on rear panel 330 may be coupled to the inner edge 352 of the add-on second side panel 350.

The add-on first side panel 340 may comprise a first set of product display apertures 345. The first set of product display apertures 345 may form at least a portion of the add-on product display apertures 311 of the first add-on display unit 300. The add-on second side panel 350 may comprise a second set of product display apertures 355. The second set of product display apertures 355 may form at least a portion of the add-on product display apertures 311 of the first add-on display unit 100.

The add-on floor panel 360 may comprise an upper surface 361 opposite a lower surface 362. The add-on floor panel 360 may comprise an inner edge 364 opposite an outer edge 363. The add-on floor panel 360 may further comprise side edges 365 extending between the inner edge 364 and the outer edge 363.

The add-on floor panel 360 may be coupled to the bottom edge 335 of the add-on rear panel 330. The add-on floor panel 360 may extend from the front surface 331 of the add-on rear panel 330. The add-on floor panel 360 may comprise locking elements 366 that may be configured to engage at least one of the first and/or second floor locking elements 346, 356 present on at least one of the add-on first or second side panels 340, 350. In a non-limiting embodiment, the locking elements 366 may be a slot that extends between the upper surface 361 and the lower surface 362 of the add-on floor panel 360. The slot may have a third width. The third width of the slot 366 of the add-on floor panel 360 may be less than second width of the head portion 346*b* of first floor locking element 346, and/or the head portion 356*b* of the second floor locking element 356. The third width of the slot 366 of the add-on floor panel 360 may be greater than first width of the neck portion 346*a* of first floor locking element 346 and/or the neck portion 356*a* of the second floor locking element 356.

The locking elements 366 of the add-on floor panel 360 may comprise a first locking element 366*a* and a second locking element 366*b*. The first locking element 366*a* and the second locking element 336*b* may be located on opposite sides of the second central axis B-B. Each of the first and second locking elements 366*a*, 366*b* may be a slot.

The slot of the first locking element 366*a* may have a third width that is greater than the first width of neck portion 346*a* of the first locking element 346. The slot of the first locking element 366*a* may have a third width that is less than the second width of head portion 346*b* of the first locking element 346.

The slot of the second locking element 366*b* may have a third width that is greater than the first width of neck portion 356*a* of the second locking element 356. The slot of the first locking element 366*a* may have a third width that is less than the second width of head portion 356*b* of the second locking element 356.

The add-on structure 310 may comprise a first pre-weakened line 315. The first pre-weakened line 315 may be located at the first side edge 333 of the add-on rear panel 330. The first pre-weakened line 315 may be located at the first inner edge 342 of the add-on first panel 340. The first pre-weakened line 315 may overlap the first inner edge 342 of the add-on first panel 340 and the first side edge 333 of the add-on rear panel 330.

The add-on structure 310 may comprise a second pre-weakened line 316. The second pre-weakened line 316 may be located at the second side edge 334 of the add-on rear panel 330. The second pre-weakened line 316 may be located at the first inner edge 352 of the add-on second panel 350. The second pre-weakened line 316 may overlap the first inner edge 352 of the add-on second panel 350 and the second side edge 334 of the add-on rear panel 330.

The add-on structure 3310 may comprise a third pre-weakened line 317. The third pre-weakened line 317 may be located at the bottom edge 335 of the add-on rear panel 330. The third pre-weakened line 317 may be located between the bottom edge 335 of the add-on rear panel 330 and the add-on floor panel 360.

The side edges 365 may comprise a first side edge 365*a* that extends between the inner edge 364 and the outer edge 363 of the add-on floor panel 360 and is located adjacent to the first pre-weakened line 315 of the add-on structure 310. The side edges 165 may comprise a second side edge 365*b* that extends between the inner edge 164 and the outer edge 363 of the add-on floor panel 360 and is located adjacent to the first second-weakened line 316 of the add-on structure 310. The first and second side edges 365*a*, 365*b* may be located on opposite sides of the second central axis B-B.

Referring now to FIG. 5, the add-on display unit 300 may be supplied in an unassembled state, whereby the add-on first side panel 340 may be flat relative to the add-on rear panel 330. The unassembled state may also be referred to "blank" or a "blank sheet." Stated otherwise, in the unassembled state, the add-on first side panel 340 may be substantially coplanar with to the add-on rear panel 330. In the unassembled state, the add-on second side panel 350 may be flat relative to the add-on rear panel 330. Stated otherwise, in the unassembled state, the add-on second side panel 350 may be substantially coplanar with to the add-on rear panel 330. In the unassembled state, the add-on floor panel 360 may be flat relative to the add-on rear panel 330. Stated otherwise, in the unassembled state, the add-on floor panel 360 may be substantially coplanar with to the add-on rear panel 330. The add-on display unit 300 may be a flat sheet in the unassembled state—whereby the flat sheet is substantially planar.

In the unassembled state, the upper surface 361 of the add-on floor panel 360 may face the same direction as the front surface 331 of the add-on rear panel 330. In the unassembled state, the lower surface 362 of the add-on floor panel 360 may face the same direction as the rear surface 332 of the add-on rear panel 330.

Referring now to FIGS. 6 and 7, the add-on display unit 300 may converted from the unassembled state to an assembled state, whereby the add-on first side panel 340 is bent relative to the add-on rear panel 330. Stated otherwise, in the assembled state, the add-on first side panel 340 may be non-coplanar with to the add-on rear panel 330. The add-on first side panel 340 may be bent relative to the add-on rear panel 330 along the first pre-weakened line 315. In the assembled state, the add-on first side panel 340 may substantially orthogonal to the add-on rear panel 330.

The add-on display unit 300 may also be converted from the unassembled state to an assembled state such that the add-on second side panel 350 is bent relative to the add-on rear panel 330. Stated otherwise, in the assembled state, the add-on second side panel 350 may be non-coplanar with to the add-on rear panel 330. The add-on second side panel 350 may be bent relative to the add-on rear panel 330 along the second pre-weakened line 316. In the assembled state, the add-on second side panel 350 may substantially orthogonal to the add-on rear panel 330. In the assembled state, the add-on first and second side panels 340, 350 may be substantially parallel.

The add-on display unit 300 may also be converted from the unassembled state to an assembled state such that the add-on floor panel 360 is bent relative to the add-on rear panel 330. Stated otherwise, in the assembled state, the add-on floor panel 360 may be non-coplanar with to the add-on rear panel 330. The add-on floor panel 360 may be bent relative to the add-on rear panel 330 along the third pre-weakened line 317. In the assembled state, the add-on floor panel 360 may substantially orthogonal to the add-on rear panel 330. In the assembled state, the add-on floor panel 360 may be substantially orthogonal to each of the first and second side panels 340, 350.

The add-on rear panel 330 and the add-on first side panel 340 may be formed from a single continuous sheet of material. The add-on rear panel 330 and the add-on second side panel 350 may be formed from a single continuous sheet of material. The add-on rear panel 330 and the add-on floor panel 360 may be formed from a single continuous sheet of material. The add-on rear panel 330, the add-on first side panel 340, and the add-on second side panel 350 may be formed from a single continuous sheet of material. The add-on rear panel 330, the add-on first side panel 340, the add-on second side panel 350, and the add-on floor panel 360 may be formed from a single continuous sheet of material.

The material that may form the add-on rear panel 330, the add-on first side panel 340, and the add-on second side panel 350 may be the same or different than the material that forms the primary structure 310. The material that forms the add-on structure 310 may be a polymeric material. In a non-limiting example, the polymeric material may be a polyester polymer, a polyurethane polymer, an acrylic polymer, a vinyl polymer, and the like. The material may be at least partially transparent. In some embodiments, the material may be completely transparent. In other embodiments, the material may be substantially opaque. In some embodiments, the material may be translucent. In some embodiments, the material may be colored by adding a pigment or dye to the material, thereby causing the material to exhibit a color on the visible spectrum.

Referring now to FIGS. 6B-6E, a plurality of second products 800 may be inserted through the add-on product display apertures 311. The plurality of second products 800 may be positioned within the add-on product display apertures 311 and supported by the add-on structure 310—as discussed in greater detail herein.

Each of the second products 800 may be the same or different than the first products 900. Each of the second products may comprise a package 810 having a product display surface 820. The add-on product display apertures 320 may be configured and arrange to support the second products 800 such that the product display surface 820 of the second products 800 are oriented at a second angle $Ø_2$ relative to the vertical plane X-Y. The second angle $Ø_2$ may be the same or different than the first angle $Ø_1$. In a preferred embodiment, second angle $Ø_2$ may be different than the first angle $Ø_1$. The vertical plane X-Y may be substantially parallel to the rear surface 332 of the primary rear panel 330. The second angle $Ø_2$ may be an acute angle so that the product display surface 820 of the second packages 800 are included upward. In some embodiments, the second angle $Ø_2$ may range from 1° to about 60°—including all angles and sub-ranges there-between. In a preferred embodiment, the second angle $Ø_2$ may range from about 2° to about 30°—including all angles and sub-ranges there-between. In a non-limiting embodiment, the second angle $Ø_2$ may range from about 2° to about 10°—including all angles and sub-ranges there-between. In such embodiments, the product display surface 820 may be oblique to at least one of the rear surface 332 of the add-on rear panel 330 and/or the front surface 331 of the add-on rear panel 330.

Each of the second packages 810 may comprise a box. Although not shown, the box may contain an oral care product. Non-limiting examples of oral care product include toothpaste, mouth wash, toothbrush, tooth whitening agent, and the like. The product display surface 820 of each box (second package 810) may comprise indicia indicative of the oral care product contained within the second package 810. Non-limiting examples of indicia include text, pictures, and various color and pattern combinations.

The package 810 may be inserted through the add-on product display apertures 311 such that at least one of the first and/or second protrusions 321, 323 contact the product display surface 820 of the package 810 (see FIGS. 6C, 6D). In another embodiment, the package 810 may be inserted through the add-on product display apertures 311 such that the first protrusion 321 may contact a bottom surface of the package 810. A rear surface of the package 810 that is opposite the product display surface 820 may contact the convex portion 319*a* of the rear wall section 319.

Referring now to FIG. 6C, a first package 810*a* having a first size may be inserted through the add-on product display apertures 311 such that the second protrusion 323 engages the package 810*a*, thereby securing it in place. Specifically, the second protrusion 323 may contact the product display surface 820*a* and the convex portion 319*a* of the rear wall section 319 may contact the rear surface of the package

810*a*. According to this embodiment, the third intersection of the second protrusion 323 may contact the product display surface 820*a* of the package 810*a*. Alternatively, the second edge 323*b* of the second protrusion 323 may contact the product display surface 820*a* of the page 810*a*.

Referring now to FIG. 6D, a second package 810*b* having a second size may be inserted through the add-on product display apertures 311. Although not shown in FIG. 6B, the second package 810*b* would be generally inserted into the add-on product display 310 as the first product 810*a* shown in FIG. 6B except for the differences described herein. The second package 810*b* may be inserted through the add-on product display apertures 311 such that the first and second protrusions 321, 323 engage the second package 810*b*, thereby securing it in place. Specifically, the second protrusion 323 may contact the bottom surface of the second package 810*b* and the first protrusion may contact the product display surface 820*b*, and the convex portion 319*a* of the rear wall section 319 may contact the rear surface of the package 810*b*. According to this embodiment, the second intersection of the second protrusion 323 may contact the bottom surface of the package 810*b*. The bottom surface of the package 820*b* may be supported vertically by the first edge 323*a* of the second protrusion 323. According to this embodiment, the first intersection of the first protrusion 321 may contact the product display surface 820*b* of the package 810*b*. The first intersection of the first protrusion 321 and the convex portion 319*a* of the rear wall section 319 may create a horizontal registration with the second package 810*b*.

Referring now to FIG. 6E, a third package 810*c* having a third size may be inserted through the add-on product display apertures 311. Although not shown in FIG. 6B, the third package 810*c* would be generally inserted into the add-on product display 310 as the first product 810*a* shown in FIG. 6B except for the differences described herein. The third package 810*c* may be inserted through the add-on product display apertures 311 such that the first and second protrusions 321, 323 engage the third package 810*c*, thereby securing it in place. Specifically, the first protrusion 321 may contact the bottom surface of the third package 810*a*. A horizontal registration may be created by contact between the front wall section 318 and the product display surface 820*c* and the convex portion 319*a* of the rear wall section 319 of the third package 810*c*. According to this embodiment, the third package 810*c* may be vertically offset from the second protrusion.

The first size of the first package 810*a* may include a first width and/or first depth that is different than that of the second package 810*b*. The first size of the first package 810*a* may have first width and/or first depth that is different than that of the third package 810*c*. The second size of the second package 810*b* may have width and/or depth that is different than that of the third package 810*c*.

Referring now to FIG. 6B, a plurality of the second products 800 may be positioned in the add-on display unit 300 by extending through the first set of product display apertures 345 of the add-on first side panel 340 and the second set of product display apertures 355 of the add-on second side panel 350. In this arrangement, the second products 300 may be supported by the first side panel 340 and the second side panel 350 so that middle portions 801 of the second products 800 are located between the add-on first side panel 340 and the add-on second side panel 350. Additionally, in this arrangement, first end portions 801 of the second products 800 protrude from the first side panel 340 in a first direction, and second end portions 802 of the second products 800 protrude from the second side panel 350 in a second direction that is opposite the first direction.

The add-on structure 310 may comprise an add-on lower mounting element 370 that is configured to engage one or more additional add-on display units 200. The add-on lower mounting element 370 may be located on the add-on rear panel 330. The add-on lower mounting element 370 may be located at a bottom portion of the add-on rear panel 330 adjacent to the add-on floor panel 360. The add-on lower mounting element 370 may be a slot that extends from the front surface 331 to the rear surface 332 of the add-on rear panel 330. In other embodiments, the add-on lower mounting element 370 may be a tab or hole (not shown).

Figure 8:
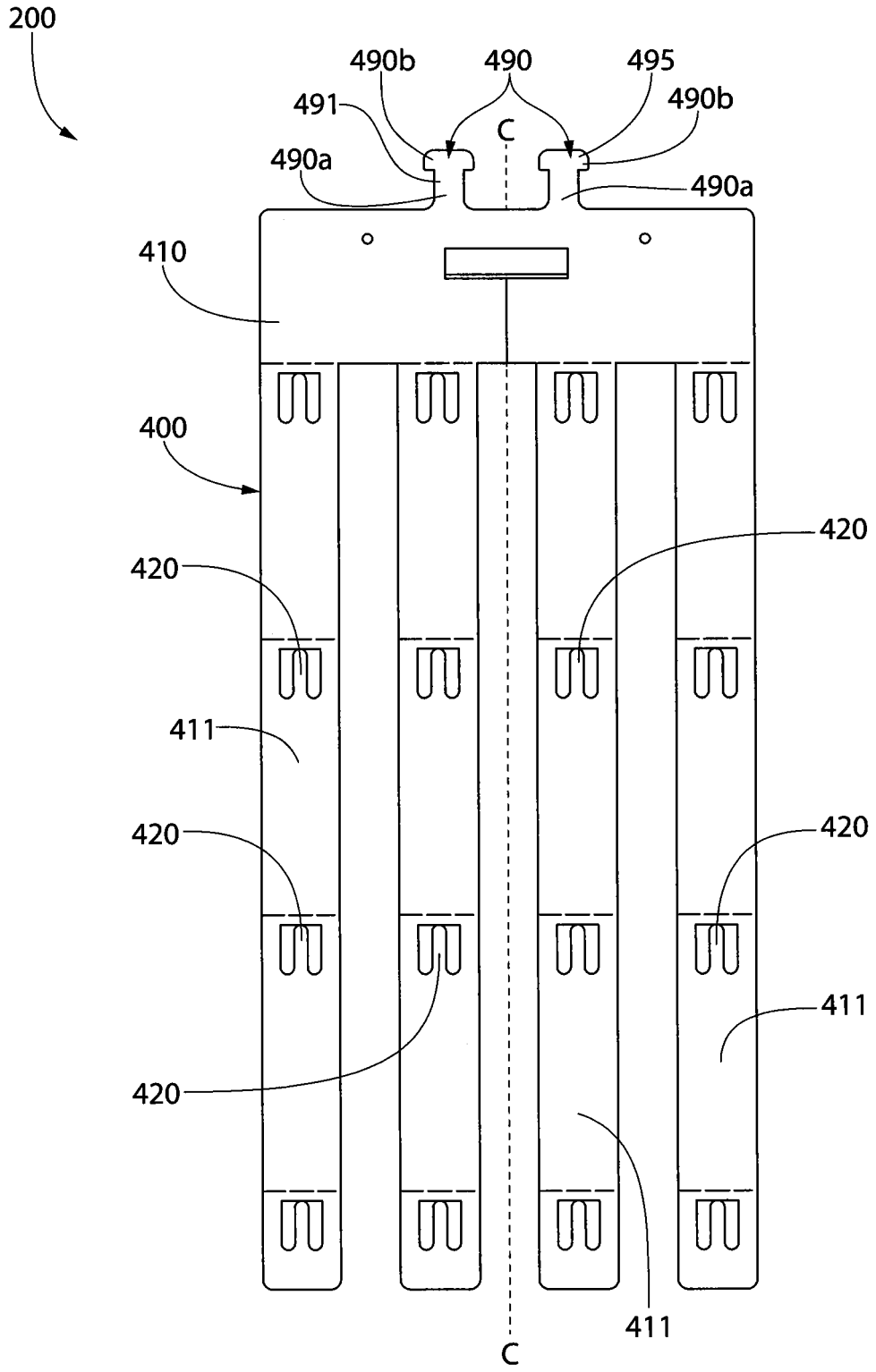
FIG. 8 is a front plan view of a second add-on display unit.
Figure 9:
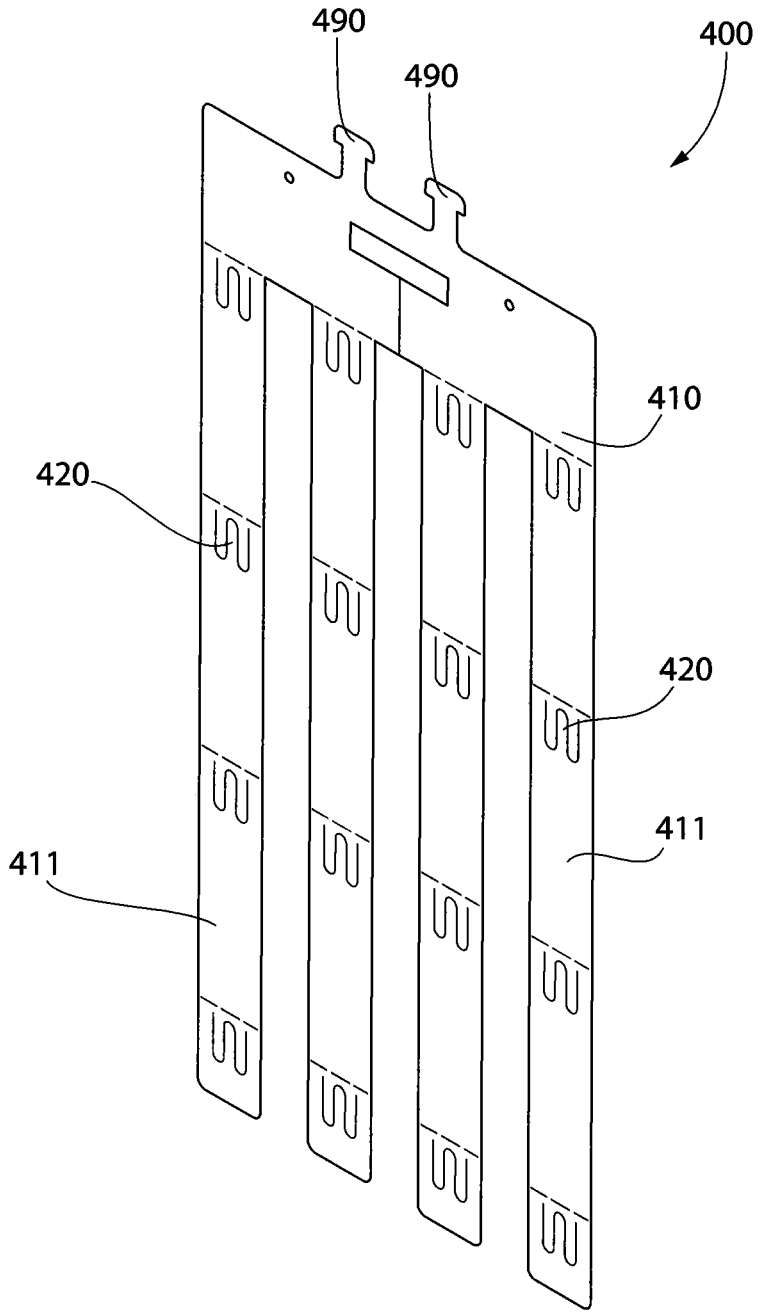
FIG. 9 is a front perspective view of the second add-on display unit of FIG. 8.

Referring now to FIGS. 8 and 9, the add-on display unit 200 may comprise a second add-on display unit 400 that is different than the first add-on display unit 300. The second add-on display unit 400 may comprise a second add-on structure 410 comprising one or more legs 411 that extend downward from an upper portion of the second add-on structure 410. Each of the legs 411 may comprise mounting element 420 configured to attach one more third products 700 thereto. In a non-limiting embodiment, the third product 700 may be packaged an oral care implement. The third product 700 may be different from each of the first and second products 900, 800.

The second add-on structure 410 may comprise a mounting element 490. The mounting element 490 of the second add-on structure 410 may be a tab like the tab of the upper mounting element 390 of first add-on display unit 300.

Referring now to FIGS. 10-15, the add-on lower mounting element 370 of the first add-on display unit 300 may be configured to engage the upper mounting element 390 of additional first add-on mounting display units 300. Additionally, the add-on lower mounting element 370 of the first add-on display unit 300 may be configured to engage mounting elements 490 of a second add-on mounting display unit 400. The add-on lower mounting element 370 may comprise a first add-on mounting element 371. The add-on lower mounting element 370 may comprise a second add-on mounting element 375. The first add-on and second add-on mounting elements 371, 375 may be located on opposite sides of the second central vertical axis B-B. In other embodiments, the add-on lower mounting element 370 may be centered on the add-on rear panel 330 such that the second central vertical axis B-B intersects at least a portion of the add-on lower mounting element 370 of the first add-on display unit 300.

The upper mounting element 390 of the first add-on display unit 300 may be configured to slideably mate with the slot of the mounting element 170 of the primary display unit 100 and lock the add-on display unit 300 to the primary display unit 100.

The mounting element 170 of the primary display unit 100 may be structurally the same as the lower mounting element 370 of the first add-on display unit 300. The mounting element 490 of a second add-on unit 400 may be structurally the same as the upper mounting element 390 of the first add-on display unit 300.

Referring now to FIG. 10, the point-of-sale display 10 may be in an unattached state, whereby the primary display unit 100 and the add-on display unit 200 are not coupled together. Referring now to FIG. 11, the point-of-sale display 10 may be in an attached state, whereby the primary display unit 100 and the add-on display unit 200 are coupled together by the engagement of the primary mounting element 170 and the upper mounting element 390 of the first add-on display unit 300.

The upper mounting element 390 may be a tab. In such embodiments, the tab may comprise a neck portion 390*a* and a head portion 390*b*. The neck portion may have a first width and the head portion 390*b* may have a second width. The second width of the head portion 390*b* may be greater than the neck portion 390*a*. Additionally, the slot of primary mounting element 170 may have a third width. The third width of the primary mounting element 170 of the primary display unit 100 may be greater than the first width of the neck portion 390*a* of the tab of the upper mounting element 390 of the first add-on display unit 300. Additionally, the third width of the primary mounting element 170 of the primary display unit 100 may be less than the second width of the head portion 390*b* of the tab of the upper mounting element 390 of the first add-on display unit 300.

Figure 15:
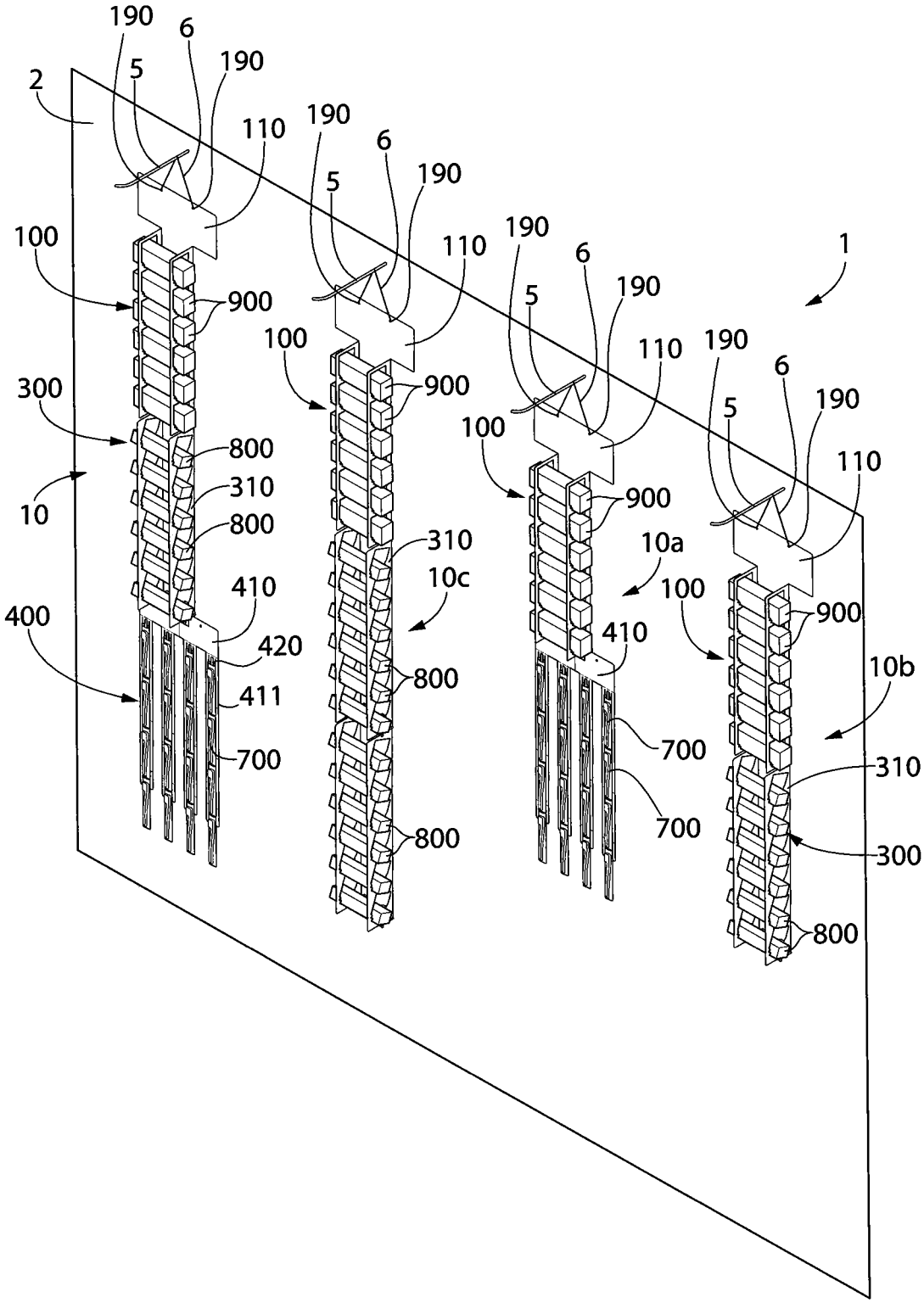
FIG. 15 is a front perspective view of the multiple modular point-of-sale displays in use according to the present invention.

In the attached state, the first set of product display apertures 145 of the primary display unit 100 may be vertically aligned with the first set of product display apertures 345 of the first add-on display unit 300 (see point-of-sale displays 10, 10*a*, and 10*c* in FIG. 15). In the attached state, the second set of product display apertures 155 of the primary display unit 100 may be vertically aligned with the second set of product display apertures 355 of the second add-on display unit 300 (see point-of-sale displays 10, 10*a*, and 10*c* in FIG. 15).

In the assembled state, the first set of product display apertures 145 of the primary display unit 100 may be horizontally aligned with the second set of product display apertures 155. In the assembled state, the first set of product display apertures 345 of the first add-on display unit 300 may be horizontally aligned with the second set of product display apertures 355 of the first add-on display unit 300.

Referring now to FIG. 15, the point-of-sale display may be primary display unit 100 may be installed into a commerce setting (i.e., a grocery store, pharmacy, and the like), by hanging the primary display unit 100 to a support structure 5. The hanger element 190 of the primary display unit 100 may further comprise an attachment member 6 that attaches the primary display unit 100 the support structure 5. Non-limiting examples of the attachment member 6 may include a wire, string, or hook. Non-limiting examples of the support structure 5 include a peg, hook, sales wrack. The support structure 5 may be attached to a larger permanently installed structure 2 within the commerce setting—such as a wall or shelf.

According to the present invention, the combination of primary display unit 100 and add-on structure 200, 300, 400, provide a means for effectively displaying various products 700, 800, 900 to a consumer at a variety of heights within a commerce setting. Specifically, by the primary display unit 1 displaying the first product 900 at the first angle $Ø_1$ and the first add-on display unit 300 simultaneously displaying the second product 800 at the second angle $Ø_2$—the product display surfaces 820, 920 of the first and second products 900, 800 can be effective viewed by the consumer from a single vertical position.

Figure 16:
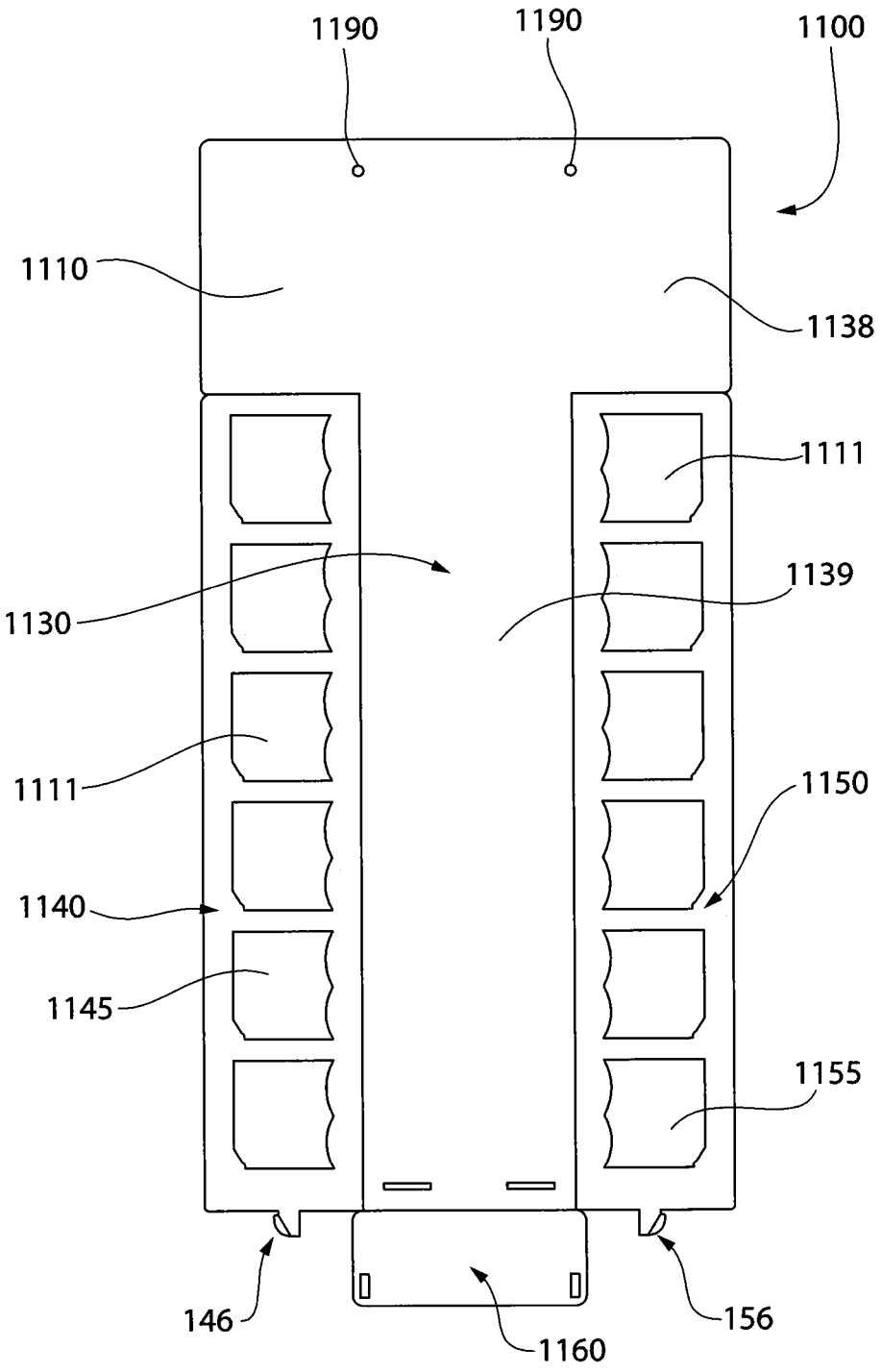
FIG. 16 is a front plan view of a primary display unit according to another embodiment in an unassembled state.
Figure 17:
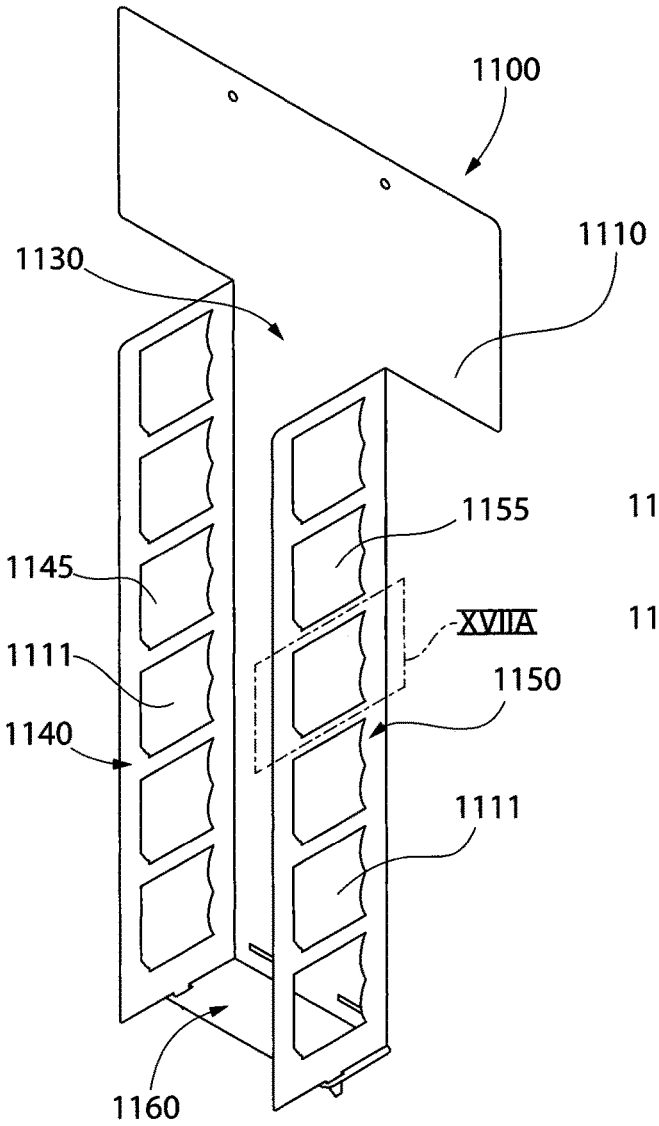
FIG. 17 is a front perspective view of the primary display unit of FIG. 16 in an assembled state.
Figure 17A:
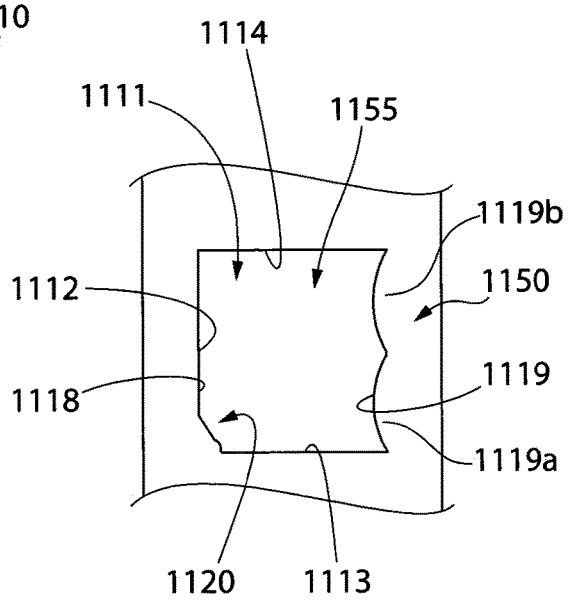
FIG. 17A is a close-up plan sideview of area XX of the primary display unit of FIG. 17 in an assembled state.
Figure 17B:
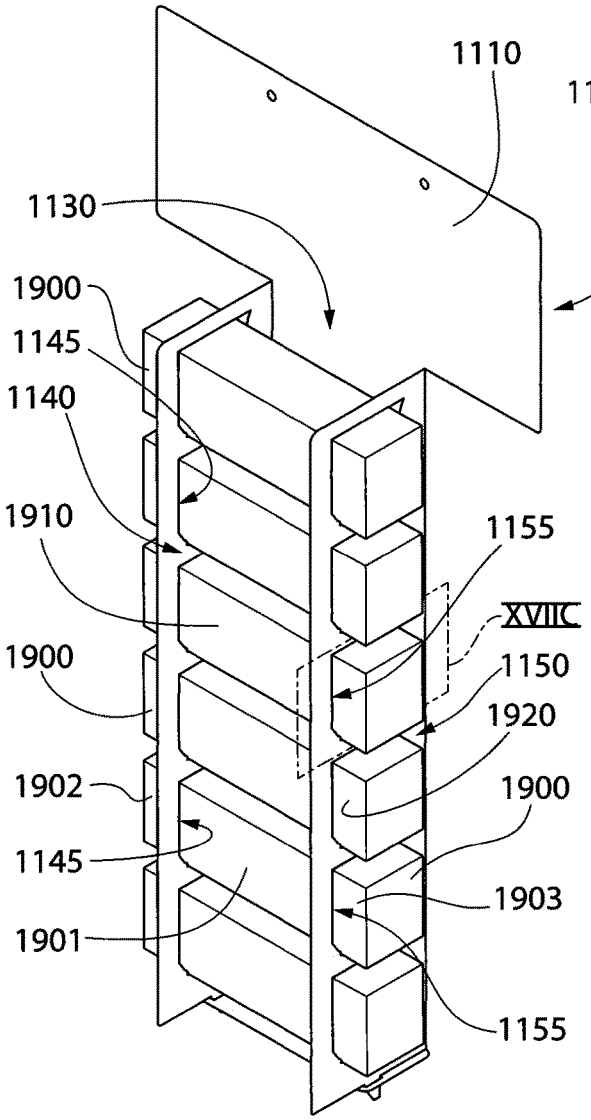
FIG. 17B is a front perspective view of the primary display unit of FIG. 17 with a plurality of packages inserted therein.
Figure 17C:
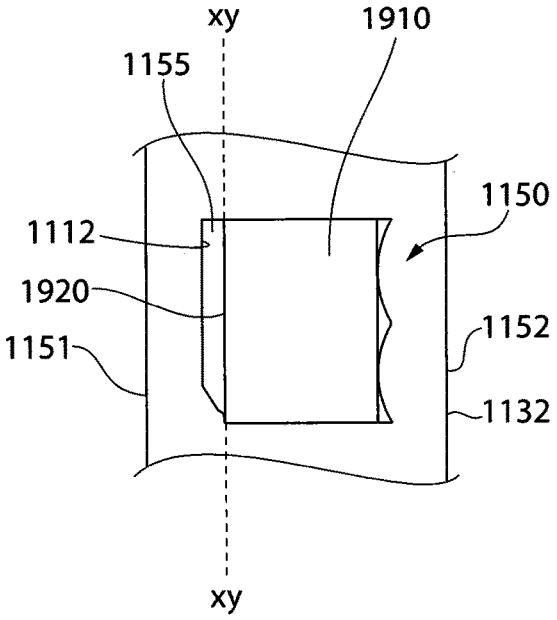
FIG. 17C is a close-up plan sideview of area XXI of the primary display unit of FIG. 17B in an assembled state with a package inserted therein.
Figure 18:
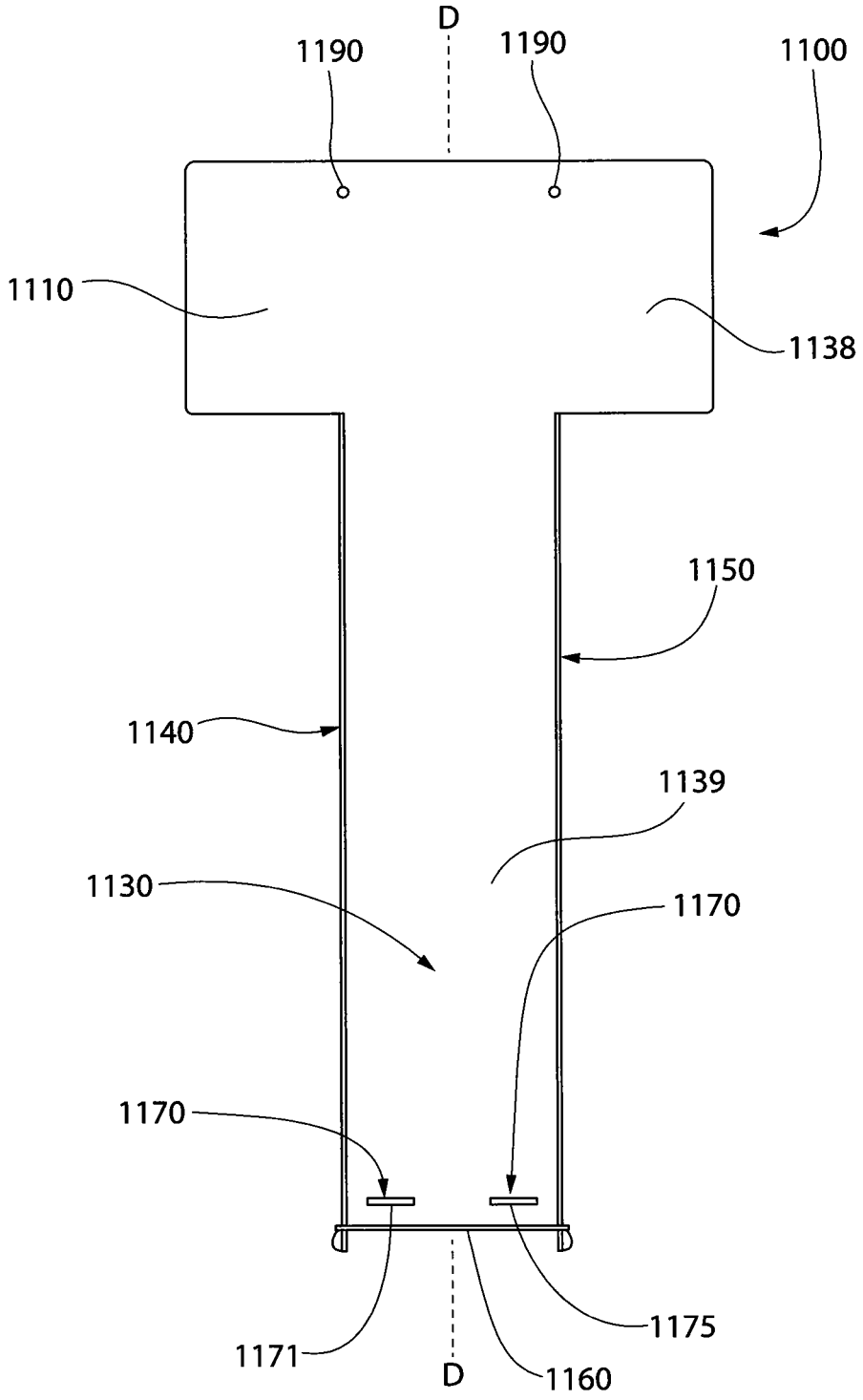
FIG. 18 is a front plan view of the primary display unit of FIG. 17 in an assembled state.

Referring now to FIGS. 16-18, a primary display unit 1100 is illustrated in accordance with another embodiment of the present invention. The primary display unit 1000 is similar to the primary display unit 100 except as described herein below. The description of the primary display unit 100 above generally applies to the primary display unit 1100 described below except with regard to the differences specifically noted below. A similar numbering scheme will be used for the primary display unit 1100 as with the primary display unit 100 except that the 100-series of numbers will be used.

The primary display unit 1100 comprises a primary multi-panel structure 110 that includes a plurality of primary product display apertures 1111. The primary apertures 1111 are configured and arranged on the primary structure 1110 to receive and support a plurality of products 1900 for display. The primary apertures 1111 may be a closed-geometry aperture defined by a primary aperture edge 1112.

The primary aperture edge 1112 may comprise a floor section 1113 opposite a roof section 1114. The primary aperture edge 1112 may further comprise a front wall section 1118 opposite a rear wall section 1119. The rear wall section 1119 of the primary aperture edge 1112 may comprise a first convex portion 1119*a* and a second convex portion 1119*ba* that extends toward the front wall section 1118.

The primary aperture edge 1112 may further comprise variable production retaining section 1120. The variable product retaining section 1120 may be located between the front wall section 1118 and the floor section 1113. The variable product retaining section 1120 may be a continuous linear segment oriented at an oblique angle relative to the front wall section 1118 and the floor section 1113. In some embodiments, the variable product retaining section 1120 may comprise a protrusion located adjacent to the floor section 1113 of the primary aperture edge 1112. The floor section 1113 of the primary apertures edge 1112 may be substantially orthogonal to the rear surface of the primary rear panel.

Exemplary Claim Set

Exemplary claim 1. A modular point-of-sale display comprising: a plurality of inter-lockable display units comprising: a primary display unit comprising: a primary structure comprising a plurality of primary product display apertures configured and arranged to receive a plurality of first products for display; a hanger element for mounting the primary display unit to a support structure; and a primary mounting element; and an add-on display unit comprising: an add-on structure comprising a plurality of add-on product display apertures configured and arranged to receive a plurality of second products for display; a first add-on mounting element configured to mate with the primary mounting element to hang the add-on display unit from the primary display unit.

Exemplary claim 2. The modular point-of-sale display according to exemplary claim 1 further comprising the first products positioned within the primary product display apertures and supported by the primary structure; and the second products positioned within the add-on product display apertures and supported by the add-on structure.

Exemplary claim 3. The modular point-of-sale display according to exemplary claim 2 further comprising: each of the first and second products comprising a package having a product display surface; the primary product display apertures configured and arranged to support the first products so that the product display surfaces of the first products are oriented at a first angle relative to a vertical plane; and the add-on product display apertures configured and arranged to support the second products so that the product display surfaces of the second products are oriented at a second angle relative to the vertical plane, the first angle being different than the first angle.

Exemplary claim 4. The modular point-of-sale display according to exemplary claim 3 wherein the first angle is a substantially zero angle so that the product display surface of the first packages are substantially vertical and the second angle is an acute angle so that the product display surface of the second packages are inclined upward.

Exemplary claim 5. The modular point-of-sale display according to any one of exemplary claims 3 to 4 wherein each of the packages of the first and second products comprises a box containing an oral care product, and wherein the product display surfaces of each of the boxes comprises indicia indicative of the oral care product.

Exemplary claim 6. The modular point-of-sale display according to any one of exemplary claims 1 to 5 further comprising: each of the primary product display apertures being a closed-geometry aperture defined by a primary aperture edge; and each of the add-on product display apertures being a closed-geometry aperture defined by an add-on aperture edge.

Exemplary claim 7. The modular point-of-sale display according to exemplary claim 6 further comprising: each of the primary aperture edges comprising a floor section, a roof section, a front wall section, and a rear wall section; each of the add-on aperture edges comprising a floor section, a roof section, a front wall section, and a rear wall section; and the floor sections of the primary aperture edges and/or the floor sections of the add-on aperture edges being downwardly inclined moving from the front wall section to the rear wall section.

Exemplary claim 8. The modular point-of-sale display according to exemplary claim 7 wherein the rear wall sections of the primary aperture edges and/or the floor sections of the add-on aperture edges comprise at least one convex portion.

Exemplary claim 9. The modular point-of-sale display according to exemplary claim 8 wherein the rear wall sections of the primary aperture edges and/or the floor sections of the add-on aperture edges further comprise a first linear portion and a second linear portion, the convex portion located between the first and second linear portions, and the first and second linear portions being offset from one another.

Exemplary claim 10. The modular point-of-sale display according to any one of exemplary claims 6 to 9 further comprising the primary aperture edges and/or the add-on aperture edges further comprising a variable product retaining section comprising a plurality of product retaining corners that are horizontally and vertically offset from one another.

Exemplary claim 11. The modular point-of-sale display according to any one of exemplary claims 1 to 10 wherein one of the primary mounting element and the first add-on mounting element comprises at least one mounting slot and the other one of the primary mounting element and the add-on mounting element comprises at least one mounting tab configured to slidably mate with the slot and lock the add-on display unit to the primary display unit.

Exemplary claim 12. The modular point-of-sale display according to any one of exemplary claims 1 to 11 further comprising: the first add-on mounting element located at a top portion of the add-on structure; and the add-on display unit further comprising, at a bottom portion of the add-on structure, a second add-on mounting element configured to mate with a first add-on mounting element of another one of the add-on display unit.

Exemplary claim 13. The modular point-of-sale display according to exemplary claim 12 wherein second add-on mounting element is structurally the same as the primary mounting element.

Exemplary claim 14. The modular point-of-sale display according to any one of exemplary claims 1 to 13 wherein one of the primary mounting element and the first add-on mounting element comprises at least one mounting slot and the other one of the primary mounting element and the add-on mounting element comprises at least one mounting tab configured to slidably mate with the slot and lock the add-on display unit to the primary display unit.

Exemplary claim 15. The modular point-of-sale display according to any one of exemplary claims 1 to 14 wherein each of the primary structure and the add-on structure is a multi-panel structure formed by bending a single sheet of material.

Exemplary claim 16. The modular point-of-sale display according to exemplary claim 15 wherein, for each of the primary structure and the add-on structure, the single sheet of material is transparent.

Exemplary claim 17. The modular point-of-sale display according to any one of exemplary claims 1 to 16 further comprising: the primary structure comprising: a primary rear panel extending along a central vertical axis and comprising first and second sides edges on opposite sides of the central vertical axis; a primary first side panel coupled to the first side edge of the primary rear panel and extending from a front surface of the primary rear panel, the primary first side panel comprising a first set of the primary product display apertures; and a primary second side panel coupled to a second side edge of the primary rear panel and extending from the front surface of the primary rear panel, the primary second side panel comprising a second set of the primary product display apertures; and the first products positioned in the primary display unit to extend through the first set of primary product display apertures and the second set of primary product display apertures, the first products supported by the primary first side panel and the primary second side panel so that middle portions of the first products are located between the primary first side panel and the primary second side panel, first end portions of the first products protrude from the primary first side panel in a first direction, and second end portions of the first products protrude from the primary second side panel in a second direction opposite the first direction.

Exemplary claim 18. The modular point-of-sale display according to exemplary claim 17 wherein the primary structure further comprises a primary floor panel coupled to a bottom edge of the primary rear panel and extending from the front surface of the primary rear panel.

Exemplary claim 19. The modular point-of-sale display according to exemplary claim 17 wherein the primary rear panel, the primary first side panel, the primary second side panel, and the primary floor panel are formed from a single sheet of material; and wherein the primary first side panel is bent relative to the primary rear panel along a first pre-weakened line along the first side edge of the primary rear panel, the primary second side panel is bent relative to the primary rear panel along a second pre-weakened line along the second side edge of the primary rear panel, and the primary floor panel is bent relative to the primary rear panel along a third pre-weakened line along the bottom edge of the primary rear panel.

Exemplary claim 20. The point-of-sale display according to any one of exemplary claims 18 to 19 wherein the primary first side panel comprises a first floor locking element engaging a first wall locking element of the primary floor panel, and the primary second side panel comprises a second floor locking element engaging a second wall locking element of the primary floor panel.

Exemplary claim 21. The point-of-sale display according to exemplary claim 20 wherein the first floor locking element of the primary first side panel comprises a locking tab extending from a bottom edge of the primary first side panel and the second floor locking element of the primary second side panel comprises a locking tab extending from a bottom edge of the primary second side panel; and wherein each of the first and second wall locking elements of the primary floor panel comprise a slot extending through the primary floor panel.

Exemplary claim 22. The modular point-of-sale display according to any one of exemplary claims 1 to 2 further comprising: the add-on display unit further comprising, for each of the add-on product display apertures, a protuberance extending into the add-on product display aperture; and each of the second products comprising a package having a mounting element engaging one of the protuberances so that the second products are hung from the add-on structure.

Exemplary claim 23. The modular point-of-sale display according to exemplary claim 22 wherein each of the second products comprises an oral care implement in the package.

Exemplary claim 24. The modular point-of-sale display according to any one of exemplary claims 1 to 23 further comprising: the add-on structure comprising: an add-on rear panel extending along a central vertical axis and comprising first and second sides edges on opposite sides of the central vertical axis; an add-on first side panel coupled to the first side edge of the add-on rear panel and extending from a front surface of the add-on rear panel, the add-on first side panel comprising a first set of the add-on product display apertures; and an add-on second side panel coupled to a second side edge of the add-on rear panel and extending from the front surface of the add-on rear panel, the add-on second side panel comprising a second set of the add-on product display apertures; and the second products positioned in the add-on display unit to extend through the first set of the add-on product display apertures and the second set of the add-on product display apertures, the second products supported by the add-on first side panel and the add-on second side panel so that middle portions of the second products are located between the add-on first side panel and the add-on second side panel, first end portions of the second products protrude from the add-on first side panel in a first direction, and second end portions of the second products protrude from the add-on second side panel in a second direction opposite the first direction.

Exemplary claim 25. The modular point-of-sale display according to exemplary claim 24 wherein the add-on structure further comprises an add-on floor panel coupled to a bottom edge of the add-on rear panel and extending from the front surface of the add-on rear panel.

Exemplary claim 26. The modular point-of-sale display according to exemplary claim 26 wherein the add-on rear panel, the add-on first side panel, the add-on second side panel, and the add-on floor panel are formed from a single sheet of material; and wherein the add-on first side panel is bent relative to the add-on rear panel along a first pre-weakened line along the first side edge of the add-on rear panel, the add-on second side panel is bent relative to the add-on rear panel along a second pre-weakened line along the second side edge of the add-on rear panel, and the add-on floor panel is bent relative to the add-on rear panel along a third pre-weakened line along the bottom edge of the add-on rear panel.

Exemplary claim 27. A point-of-sale display comprising: a display unit comprising: a hanger element for mounting the display unit to a support structure; a rear panel extending along a central vertical axis and comprising first and second sides edges on opposite sides of the central vertical axis; a first side panel coupled to the first side edge of the rear panel and extending from a front surface of the rear panel, the first side panel comprising a first set of product display apertures; and a second side panel coupled to a second side edge of the rear panel and extending from the front surface of the rear panel, the second side panel comprising a second set of product display apertures; and a plurality of products positioned in the display unit to extend through the first set of product display apertures and the second set of product display apertures, the products supported by the first side panel and the second side panel so that middle portions of the products are located between the first side panel and the second side panel, first end portions of the products protrude from the first side panel in a first direction, and second end portions of the products protrude from the second side panel in a second direction opposite the first direction.

Exemplary claim 28. The point-of-sale display according to exemplary claim 27 wherein the rear panel, the first side panel and the second side panel are formed from a single sheet of material.

Exemplary claim 29. The point-of-sale display according to exemplary claim 28 wherein the first side panel is bent relative to the rear panel along a first pre-weakened line along the first side edge of the rear panel and the second side panel is bent relative to the rear panel along a second pre-weakened line along the second side edge of the rear panel.

Exemplary claim 30. The point-of-sale display according to any one of exemplary claims 28 to 29 wherein the single sheet of material is at least partially transparent.

Exemplary claim 31. The point-of-sale display according to any one of exemplary claims 27 to 30 wherein the product display apertures of the first set of product display apertures of the first side panel are vertically aligned with one another, and wherein the product display apertures of the second set of product display apertures of the second side panel are vertically aligned with one another.

Exemplary claim 32. The point-of-sale display according to any one of exemplary claims 27 to 31 wherein each of the product display apertures of the first set of product display apertures of the first side panel is horizontally aligned with one a corresponding one of the product display apertures of the second set of product display apertures of the second side panel.

Exemplary claim 33. The point-of-sale display according to any one of exemplary claims 27 to 32 wherein the display unit comprises a floor panel coupled to a bottom edge of the rear panel and extending from the front surface of the rear panel.

Exemplary claim 34. The point-of-sale display according to exemplary claim 33 wherein the rear panel, the first side panel, the second side panel, and the floor panel are formed from a single sheet of material.

Exemplary claim 35. The point-of-sale display according to exemplary claim 34 wherein the floor panel is bent relative to the rear panel along a third pre-weakened line along the bottom edge of the rear panel.

Exemplary claim 36. The point-of-sale display according to any one of exemplary claims 33 to 35 wherein the first side panel comprises a floor locking element engaging a first wall locking element of the floor panel, and the second side panel comprises a floor locking element engaging a second wall locking element of the floor panel.

Exemplary claim 37. The point-of-sale display according to any one of exemplary claims 27 to 36 wherein the rear panel comprises a header section and a central section extending downward from the header section, the header section having a width that is greater than the width of the central section.

Exemplary claim 38. The point-of-sale display according to exemplary claim 37 wherein the central section comprises the first side edge of the rear panel to which the first side panel is coupled, and the central section comprises the second side edge of the rear panel to which the second side panel is coupled.

Exemplary claim 39. The point-of-sale display according to any one of exemplary claims 27 to 38 wherein each of the product display apertures of the first and second sets of product display apertures is a closed-geometry aperture defined by an aperture edge.

Exemplary claim 40. The point-of-sale display according to exemplary claim 39 wherein each of the aperture edges comprises a variable product retaining section comprising a plurality of product retaining corners that are horizontally and vertically offset from one another.

Exemplary claim 41. The point-of-sale display according to any one of exemplary claims 27 to 40 further comprising: each of the products comprising a package having a product display surface; and the product display apertures configured and arranged to support the first products so that the product display surfaces of the products are inclined upward relative to the vertical central axis.

Exemplary claim 42. A point-of-sale display comprising: a display unit formed of a single sheet of folded material, the display unit comprising: a hanger element for mounting the primary display unit to a support structure; a first set of product display apertures; and a second set of product display apertures; and a plurality of products positioned in the display unit to extend through the first set of product display apertures and the second set of product display apertures.

Exemplary claim 43. A blank for forming a product display unit, the blank comprising: a flat sheet of material; a first pre-weakened line formed in the flat sheet of material; a second pre-weakened line formed in the flat sheet of material, a rear panel being formed between the first and second pre-weakened lines, a first side panel formed between the first pre-weakened line and a first side edge of the flat sheet of material, and a second side panel formed between the second pre-weakened line and a second side edge of the flat sheet of material; a first set of product display apertures formed in the first side panel; and a second set of product display apertures formed in the second side panel aligned with the first set of product display apertures.

Exemplary claim 44. The blank according to exemplary claim 43 further comprising a third pre-weakened line formed in the flat sheet of material extending between the first and second pre-weakened lines, a floor panel being formed between the third pre-weakened line and a bottom edge of the flat sheet of material.

Exemplary claim 45. The blank according to exemplary claim 44 further comprising: a first mounting element located at a top portion of the flat sheet of material; and a second mounting element configured to mate with the first mounting element, the second mounting element located at a bottom portion of the flat sheet of material.

Exemplary claim 46. The blank according to exemplary claim 45 wherein one of the first and second mounting elements comprises at least one mounting slot and the other one of the first and second mounting elements comprises at least one mounting tab configured to slidably mate with the slot.

Exemplary claim 47. The blank according to any one of exemplary claims 43 to 46 wherein each of the product display apertures of the first and second sets of product display apertures is a closed-geometry aperture defined by an aperture edge; and wherein each of the aperture edges comprises a variable product retaining section comprising a plurality of product retaining corners that are horizontally and vertically offset from one another.

Exemplary claim 48. The blank according to any one of exemplary claims 43 to 47 further comprising: the rear panel extending along a central axis; each of the product display apertures of the first and second sets of product display apertures is a closed-geometry aperture defined by an aperture edge comprising a floor section, a roof section, a front wall section, and a rear wall section; and the floor sections of the aperture edges being inclined relative to the central axis.

The invention claimed is:

1. A modular point-of-sale display comprising:

a plurality of inter-lockable display units comprising:

a primary display unit comprising:

a primary structure comprising a plurality of primary product display apertures configured and arranged to receive a plurality of first products for display;

a hanger element for mounting the primary display unit to a support structure; and a primary mounting element; and an add-on display unit comprising:

an add-on structure comprising a plurality of add-on product display apertures configured and arranged to receive a plurality of second products for display;

a first add-on mounting element configured to mate with the primary mounting element to hang the add-on display unit from the primary display unit;

the first products positioned within the primary product display apertures and supported by the primary structure; and the second products positioned within the add-on product display apertures and supported by the add-on structure, wherein each of the first and second products comprises a package having a product display surface; and wherein the primary product display apertures are configured and arranged to support the first products so that the product display surfaces of the first products are oriented at a first angle relative to a vertical plane; and wherein the add-on product display apertures are configured and arranged to support the second products so that the product display surfaces of the second products are oriented at a second angle relative to the vertical plane, the first angle being different than the second angle.

2. The modular point-of-sale display according to claim 1 wherein the first angle is a substantially zero angle so that the product display surface of the first packages are substantially vertical and the second angle is an acute angle so that the product display surface of the second packages are inclined upward.

3. The modular point-of-sale display according to claim 2 wherein each of the packages of the first and second products comprises a box containing an oral care product, and wherein the product display surfaces of each of the boxes comprises indicia indicative of the oral care product.

4. The modular point-of-sale display according to claim 1, further comprising:

each of the primary product display apertures being a closed-geometry aperture defined by a primary aperture edge; and each of the add-on product display apertures being a closed-geometry aperture defined by an add-on aperture edge, wherein each of the primary aperture edges comprising a floor section, a roof section, a front wall section, and a rear wall section;

each of the add-on aperture edges comprising a floor section, a roof section, a front wall section, and a rear wall section; and the floor sections of the primary aperture edges and/or the floor sections of the add-on aperture edges being downwardly inclined moving from the front wall section to the rear wall section.

5. The modular point-of-sale display according to claim 4 wherein the rear wall sections of the primary aperture edges and/or the floor sections of the add-on aperture edges comprise at least one convex portion and wherein the rear wall sections of the primary aperture edges and/or the floor sections of the add-on aperture edges further comprise a first linear portion and a second linear portion, the convex portion located between the first and second linear portions, and the first and second linear portions being offset from one another.

6. The modular point-of-sale display according to claim 4 wherein the primary aperture edges and/or the add-on aperture edges further comprise a variable product retaining section comprising a plurality of product retaining corners that are horizontally and vertically offset from one another.

7. The modular point-of-sale display according to claim 1 wherein one of the primary mounting element and the first add-on mounting element comprises at least one mounting slot and the other one of the primary mounting element and the add-on mounting element comprises at least one mounting tab configured to slidably mate with the slot and lock the add-on display unit to the primary display unit.

8. The modular point-of-sale display according to claim 1 further comprising:

the first add-on mounting element located at a top portion of the add-on structure; and the add-on display unit further comprising, at a bottom portion of the add-on structure, a second add-on mounting element configured to mate with a first add-on mounting element of another one of the add-on display unit, wherein the second add-on mounting element is structurally the same as the primary mounting element.

9. The modular point-of-sale display according to claim 1 wherein each of the primary structure and the add-on structure is a multi-panel structure formed by bending a single sheet of material.

10. The modular point-of-sale display according to claim 1 further comprising:

the primary structure comprising:

a primary rear panel extending along a central vertical axis and comprising first and second sides edges on opposite sides of the central vertical axis;

a primary first side panel coupled to the first side edge of the primary rear panel and extending from a front surface of the primary rear panel, the primary first side panel comprising a first set of the primary product display apertures; and a primary second side panel coupled to a second side edge of the primary rear panel and extending from the front surface of the primary rear panel, the primary second side panel comprising a second set of the primary product display apertures; and the first products positioned in the primary display unit to extend through the first set of primary product display apertures and the second set of primary product display apertures, the first products supported by the primary first side panel and the primary second side panel so that middle portions of the first products are located between the primary first side panel and the primary second side panel, first end portions of the first products protrude from the primary first side panel in a first direction, and second end portions of the first products protrude from the primary second side panel in a second direction opposite the first direction.

11. The modular point-of-sale display according to claim 10 wherein the primary structure further comprises a primary floor panel coupled to a bottom edge of the primary rear panel and extending from the front surface of the primary rear panel, wherein the primary rear panel, the primary first side panel, the primary second side panel, and the primary floor panel are formed from a single sheet of material; and wherein the primary first side panel is bent relative to the primary rear panel along a first pre-weakened line along the first side edge of the primary rear panel, the primary second side panel is bent relative to the primary rear panel along a second pre-weakened line along the second side edge of the primary rear panel, and the primary floor panel is bent relative to the primary rear panel along a third pre-weakened line along the bottom edge of the primary rear panel.

12. The modular point-of-sale display according to claim 11 wherein the primary first side panel comprises a first floor locking element engaging a first wall locking element of the primary floor panel, and the primary second side panel comprises a second floor locking element engaging a second wall locking element of the primary floor panel, wherein the first floor locking element of the primary first side panel comprises a locking tab extending from a bottom edge of the primary first side panel and the second floor locking element of the primary second side panel comprises a locking tab extending from a bottom edge of the primary second side panel; and wherein each of the first and second wall locking elements of the primary floor panel comprise a slot extending through the primary floor panel.

13. The modular point-of-sale display according to claim 1 further comprising:

the add-on display unit further comprising, for each of the add-on product display apertures, a protuberance extending into the add-on product display aperture; and each of the second products comprising a package having a mounting element engaging one of the protuberances so that the second products are hung from the add-on structure, wherein each of the second products comprises an oral care implement in the package.

14. The modular point-of-sale display according to claim 1 further comprising:

the add-on structure comprising:

an add-on rear panel extending along a central vertical axis and comprising first and second sides edges on opposite sides of the central vertical axis;

an add-on first side panel coupled to the first side edge of the add-on rear panel and extending from a front surface of the add-on rear panel, the add-on first side panel comprising a first set of the add-on product display apertures; and an add-on second side panel coupled to a second side edge of the add-on rear panel and extending from the front surface of the add-on rear panel, the add-on second side panel comprising a second set of the add-on product display apertures; and the second products positioned in the add-on display unit to extend through the first set of the add-on product display apertures and the second set of the add-on product display apertures, the second products supported by the add-on first side panel and the add-on second side panel so that middle portions of the second products are located between the add-on first side panel and the add-on second side panel, first end portions of the second products protrude from the add-on first side panel in a first direction, and second end portions of the second products protrude from the add-on second side panel in a second direction opposite the first direction, wherein the add-on structure further comprises an add-on floor panel coupled to a bottom edge of the add-on rear panel and extending from the front surface of the add-on rear panel, wherein the add-on rear panel, the add-on first side panel, the add-on second side panel, and the add-on floor panel are formed from a single sheet of material; and wherein the add-on first side panel is bent relative to the add-on rear panel along a first pre-weakened line along the first side edge of the add-on rear panel, the add-on second side panel is bent relative to the add-on rear panel along a second pre-weakened line along the second side edge of the add-on rear panel, and the add-on floor panel is bent relative to the add-on rear panel along a third pre-weakened line along the bottom edge of the add-on rear panel.

* * * * *